US008444826B2

(12) United States Patent
Danby et al.

(10) Patent No.: US 8,444,826 B2
(45) Date of Patent: May 21, 2013

(54) INDUSTRIAL FILTRATION FABRIC WITH HIGH CENTER PLANE RESISTANCE

(75) Inventors: Roger Danby, Arnprior (CA); Dale B. Johnson, Ottawa (CA)

(73) Assignee: AstenJohnson, Inc., Charleston, SC (US)

( * ) Notice: Subject to any disclaimer, the term of this patent is extended or adjusted under 35 U.S.C. 154(b) by 183 days.

(21) Appl. No.: 12/918,905

(22) PCT Filed: Feb. 20, 2009

(86) PCT No.: PCT/CA2009/000214
§ 371 (c)(1),
(2), (4) Date: Nov. 1, 2010

(87) PCT Pub. No.: WO2009/103167
PCT Pub. Date: Aug. 27, 2009

(65) Prior Publication Data

US 2011/0030909 A1 Feb. 10, 2011

(30) Foreign Application Priority Data

Feb. 22, 2008 (CA) ..... 2622653

(51) Int. Cl.
*D21F 1/00* (2006.01)

(52) U.S. Cl.
USPC ..... 162/348; 139/383 A

(58) Field of Classification Search
USPC ..... 162/348, 358; 139/383 A
See application file for complete search history.

(56) References Cited

U.S. PATENT DOCUMENTS

| | | | | |
|---|---|---|---|---|
| 2,800,701 | A * | 7/1957 | Hainsworth et al. | 198/847 |
| 4,308,897 | A * | 1/1982 | Westhead | 139/383 A |
| 4,379,735 | A | 4/1983 | MacBean | |
| 4,640,741 | A | 2/1987 | Tsuneo | |
| 4,649,964 | A * | 3/1987 | Smith | 139/383 A |
| 4,941,514 | A | 7/1990 | Taipale | |
| 5,169,709 | A | 12/1992 | Fleischer | |
| 5,358,014 | A | 10/1994 | Kovar | |
| 5,454,405 | A | 10/1995 | Hawes | |
| 5,826,627 | A | 10/1998 | Seabrook et al. | |
| 6,202,705 | B1 | 3/2001 | Johnson et al. | |
| 6,207,598 | B1 * | 3/2001 | Lee et al. | 442/206 |
| 6,240,973 | B1 | 6/2001 | Stone et al. | |
| 6,334,467 | B1 | 1/2002 | Barrett et al. | |
| 6,397,899 | B1 * | 6/2002 | Kobayashi et al. | 139/383 A |
| 6,530,398 | B1 | 3/2003 | Westerkamp | |

(Continued)

FOREIGN PATENT DOCUMENTS

CA 2579591 4/2006

*Primary Examiner* — Jacob Thomas Minskey
(74) *Attorney, Agent, or Firm* — Volpe and Koenig, P.C.

(57) ABSTRACT

A flat woven industrial filtration fabric comprises three layers of weft yarns. A first set of warp yarns interweaves only with paper side layer weft yarns and intermediate weft yarns, and a second set of warp yarns interweaves only with machine side layer weft yarns and the intermediate yarns, the first warp yarns and the second warp yarns interweaving with the same intermediate weft yarns at common turning points. The first warp yarns comprise groups of intrinsic binder yarns forming a single combined path on the paper side surface, and the second warp yarns are woven as individual yarns or in groups, such as pairs or triplets. The distinct nature of the paper side and machine side layers increases the available combinations of weave patterns to optimize the characteristics for each layer, and the distinct centre planes between the three layers provide improved drainage control.

23 Claims, 16 Drawing Sheets

10

U.S. PATENT DOCUMENTS

| | | | | |
|---|---|---|---|---|
| 6,581,645 | B1 | 6/2003 | Johnson et al. | |
| 7,008,512 | B2 | 3/2006 | Rougvie et al. | |
| 7,108,020 | B2 | 9/2006 | Stone | |
| 7,426,944 | B2 | 9/2008 | Danby et al. | |
| 2004/0238062 | A1 * | 12/2004 | Quigley et al. | 139/383 A |
| 2006/0278294 | A1 * | 12/2006 | Quigley | 139/383 A |
| 2009/0107574 | A1 * | 4/2009 | Bella | 139/383 A |

* cited by examiner

| | 610 | | | | | | | | | | | | 620 | | | | | | | | | | | |
|---|---|---|---|---|---|---|---|---|---|---|---|---|---|---|---|---|---|---|---|---|---|---|---|---|
| | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | 19′ | 20′ | 21′ | 22′ | 23′ | 24′ |
| 1 | | 2′ | | | | 6′ | | | 9′ | | | | | | | | | | | | | | | |
| 2 | | 2′ | 3′ | 4′ | | 6′ | 7′ | 8′ | 9′ | 10′ | 11′ | 12′ | 13′ | 14′ | | | 17′ | 18′ | | | | | | |
| 3 | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | 19′ | 20′ | | | 23′ | 24′ |
| 4 | | | | 4′ | | | | 8′ | | | 11′ | | | | | | | | | | | | | |
| 5 | | 2′ | | | | 6′ | | | | 10′ | | | | | | | | | | | | | | |
| 6 | 1′ | 2′ | | 4′ | 5′ | 6′ | | 8′ | 9′ | 10′ | 11′ | 12′ | | | 15′ | 16′ | | | 19′ | 20′ | | | | |
| 7 | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | 19′ | 20′ | 21′ | 22′ | | |
| 8 | | | | 4′ | | | | 8′ | | | | 12′ | | | | | | | | | | | | |
| 9 | | 2′ | | | | 6′ | | | | 10′ | | | | | | | | | | | | | | |
| 10 | 1′ | 2′ | 3′ | 4′ | | 6′ | 7′ | 8′ | | 10′ | 11′ | 12′ | | | | | 17′ | 18′ | | | 21′ | 22′ | | |
| 11 | 1′ | 2′ | 3′ | 4′ | 5′ | 6′ | 7′ | 8′ | 9′ | 10′ | 11′ | 12′ | | | 15′ | 16′ | 17′ | 18′ | 19′ | 20′ | 21′ | 22′ | 23′ | 24′ |
| 12 | | | | 4′ | | | | 8′ | | | | 12′ | | | | | | | | | | | | |
| 13 | 1′ | | | | | 6′ | | | | 10′ | | | | | | | | | | | | | | |
| 14 | 1′ | 2′ | 3′ | 4′ | 5′ | 6′ | | 8′ | 9′ | 10′ | | 12′ | | | | | | | 19′ | 20′ | | | 23′ | 24′ |
| 15 | 1′ | 2′ | 3′ | 4′ | 5′ | 6′ | 7′ | 8′ | 9′ | 10′ | 11′ | 12′ | 13′ | 14′ | | | 17′ | 18′ | 19′ | 20′ | 21′ | 22′ | 23′ | 24′ |
| 16 | | | 3′ | | | | | 8′ | | | | 12′ | | | | | | | | | | | | |
| 17 | 1′ | | | | | 6′ | | | | 10′ | | | | | | | | | | | | | | |
| 18 | 1′ | | 3′ | 4′ | 5′ | 6′ | 7′ | 8′ | | 10′ | 11′ | 12′ | 13′ | 14′ | | | | | | | 21′ | 22′ | | |
| 19 | 1′ | 2′ | 3′ | 4′ | 5′ | 6′ | 7′ | 8′ | 9′ | 10′ | 11′ | 12′ | 13′ | 14′ | 15′ | 16′ | | | 19′ | 20′ | 21′ | 22′ | 23′ | 24′ |
| 20 | | | 3′ | | | | | 8′ | | | | 12′ | | | | | | | | | | | | |
| 21 | 1′ | | | | 5′ | | | | | 10′ | | | | | | | | | | | | | | |
| 22 | 1′ | 2′ | 3′ | | 5′ | 6′ | 7′ | 8′ | 9′ | 10′ | | 12′ | | | 15′ | 16′ | | | | | | | 23′ | 24′ |
| 23 | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | | | 21′ | 22′ | 23′ | 24′ |
| 24 | | | 3′ | | | | 7′ | | | | | 12′ | | | | | | | | | | | | |
| 25 | 1′ | | | | 5′ | | | | | 10′ | | | | | | | | | | | | | | |
| 26 | 1′ | | 3′ | 4′ | 5′ | | 7′ | 8′ | 9′ | 10′ | 11′ | 12′ | 13′ | 14′ | | | 17′ | 18′ | | | | | | |
| 27 | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | 19′ | 20′ | | | 23′ | 24′ |
| 28 | | | 3′ | | | | 7′ | | | | | 12′ | | | | | | | | | | | | |
| 29 | 1′ | | | | 5′ | | | | 9′ | | | | | | | | | | | | | | | |
| 30 | 1′ | 2′ | 3′ | | 5′ | 6′ | 7′ | | 9′ | 10′ | 11′ | 12′ | | | 15′ | 16′ | | | 19′ | 20′ | | | | |
| 31 | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | 19′ | 20′ | 21′ | 22′ | | |
| 32 | | | 3′ | | | | 7′ | | | | 11′ | | | | | | | | | | | | | |
| 33 | 1′ | | | | 5′ | | | | 9′ | | | | | | | | | | | | | | | |
| 34 | 1′ | 2′ | 3′ | 4′ | 5′ | | 7′ | 8′ | 9′ | | 11′ | 12′ | | | | | 17′ | 18′ | | | 21′ | 22′ | | |
| 35 | 1′ | 2′ | 3′ | 4′ | 5′ | 6′ | 7′ | 8′ | 9′ | 10′ | 11′ | 12′ | | | 15′ | 16′ | 17′ | 18′ | 19′ | 20′ | 21′ | 22′ | 23′ | 24′ |
| 36 | | | 3′ | | | | 7′ | | | | 11′ | | | | | | | | | | | | | |
| 37 | | 2′ | | | 5′ | | | | 9′ | | | | | | | | | | | | | | | |
| 38 | 1′ | 2′ | 3′ | 4′ | 5′ | 6′ | 7′ | | 9′ | 10′ | 11′ | | | | | | | | 19′ | 20′ | | | 23′ | 24′ |
| 39 | 1′ | 2′ | 3′ | 4′ | 5′ | 6′ | 7′ | 8′ | 9′ | 10′ | 11′ | 12′ | 13′ | 14′ | | | 17′ | 18′ | 19′ | 20′ | 21′ | 22′ | 23′ | 24′ |
| 40 | | | | 4′ | | | 7′ | | | | 11′ | | | | | | | | | | | | | |
| 41 | | 2′ | | | 5′ | | | | 9′ | | | | | | | | | | | | | | | |
| 42 | | 2′ | 3′ | 4′ | 5′ | 6′ | 7′ | 8′ | 9′ | | 11′ | 12′ | 13′ | 14′ | | | | | | | 21′ | 22′ | | |
| 43 | 1′ | 2′ | 3′ | 4′ | 5′ | 6′ | 7′ | 8′ | 9′ | 10′ | 11′ | 12′ | 13′ | 14′ | 15′ | 16′ | | | 19′ | 20′ | 21′ | 22′ | 23′ | 24′ |
| 44 | | | | 4′ | | | 7′ | | | | 11′ | | | | | | | | | | | | | |
| 45 | | 2′ | | | | 6′ | | | 9′ | | | | | | | | | | | | | | | |
| 46 | 1′ | 2′ | | 4′ | 5′ | 6′ | 7′ | 8′ | 9′ | 10′ | 11′ | | | | 15′ | 16′ | | | | | | | 23′ | 24′ |
| 47 | 1′ | 2′ | 3′ | 4′ | 5′ | 6′ | 7′ | 8′ | 9′ | 10′ | 11′ | 12′ | 13′ | 14′ | 15′ | 16′ | 17′ | 18′ | | | 21′ | 22′ | 23′ | 24′ |
| 48 | | | | 4′ | | | | 8′ | | | 11′ | | | | | | | | | | | | | |

106

FIG. 6A

INDUSTRIAL FILTRATION FABRIC WITH HIGH CENTER PLANE RESISTANCE

FIELD OF THE INVENTION

The invention concerns industrial filtration fabrics for use in a web consolidation machine such as a papermaking machine. It is particularly concerned with fabrics of this type that are constructed using three layers of weft yarns interwoven by two systems of warp yarns, where the warp yarns in at least the paper side layer are comprised of groups of at least two yarns which together form a continuous warp yarn path on the paper side surface of the fabric. The warp yarns in the paper side layer also interweave with intermediate weft yarns but not with machine side layer weft yarns, and the warp yarns in the machine side layer also interweave with intermediate weft yarns but not with paper side weft yarns.

BACKGROUND OF THE INVENTION

The term "industrial filtration fabric" as used herein refers to woven fabrics such as are used to drain, form or otherwise consolidate a dispersion or dilute slurry of fibers or similar solids into a somewhat cohesive mat or web. Such fabrics provide a moving support surface to receive the initial deposit of the dispersion or slurry, and carry or otherwise support it for a suitable distance. Apertures through the fabric can provide drainage for liquids, while the incipient cohesive mat or web of solids is being formed.

One type of industrial filtration fabric, for which the present invention is particularly applicable, is a "papermakers fabric". This term refers to industrial textiles that are used in the process of making paper and similar sheet products; and such fabrics include forming fabrics, press felts and dryer fabrics. The present invention is particularly relevant to papermakers' forming fabrics which are used to form a continuous web of cellulosic fibers.

In relation to these industrial filtration fabrics, the term "paper side" or PS refers to the substantially planar surface of the fabric upon which the cohesive mat or web is formed or, in the later stages, transported. The term "machine side" or MS refers to the surface which is located opposite the paper side and is generally in moving contact with various stationary elements of the machine in which it is used, such as the drainage elements, rolls, foils and blades of a papermaking machine. In the discussion below, the novel fabrics of the present invention are described primarily in the context of the papermaking process, but it is to be understood that the invention is not so limited and the invention will find utility in numerous other specific industrial filtration applications, including pulp dewatering and pulp cake formation, sewage treatment, nonwovens formation and conveyance, and the like.

In the papermaking process, a very dilute slurry of about 1% papermaking fibers together with a mixture of about 99% water and other papermaking components is ejected at high speed and precision from the slice opening of a headbox on to the PS of a moving forming fabric. The fabric is guided and driven by a number of rolls over various drainage boxes and foils which assist in the removal of water through the fabric so as to leave behind a randomly dispersed, loosely cohesive network or web of papermaking fibers. At the end of the forming section, this web is transferred to the press section, where further water removal occurs by mechanical pressures as the web is conveyed on or between a series of press fabrics and is guided through one or more nips. The now self-supporting but still very wet web is then transferred to the dryer section of the papermaking machine where the remaining water is removed by evaporation. The resulting paper product may then be exposed to various treatments before it is then finally wound onto a reel, cut to size and packaged for shipment.

It is widely acknowledged that the forming fabric plays a critical role in the initial formation of the paper web. The forming fabric is required to simultaneously satisfy a number of physical requirements. It must be rugged, so as to withstand over time the continuous moving contact to which its lower (machine side) surface is exposed as it is driven over the various stationary contact surfaces in the forming section. It must be stable, so that it does not crease or skew during operation. At the same time, it must provide an appropriate PS surface, which for smooth paper products is required to be very fine, upon which the individual fibers in the stock slurry are deposited, along with any added fines and fillers, so as to form a planar web which will eventually be consolidated into a continuous sheet following water removal in the downstream sections of the papermaking machine. The fineness of the fabric used in the papermaking process (i.e. the size of the yarns, openings in the mesh and number of support points per unit area provided by the fabric) will be dictated partly by the length of the papermaking fibers used in the stock and partly by the end use requirements of the paper product being formed.

It is also known that increasing the fineness of the yarns for the fabric, i.e. by reducing their diameter, together with increasing the yarn count, provides increased support for shorter papermaking fibers; however, this leads to problems in providing sufficient mechanical stability for the fabric. A further result of using smaller diameter yarns is that it can provide a more open fabric structure, so that the sheet will be dryer on leaving the couch at the end of the forming section.

Papermaking fibers are increasingly derived from recycled materials, and such fibers are generally shorter in length than fibers obtained from virgin sources, e.g. 0.5-1.5 mm for recycle fibers, in contrast with 2-4 mm for virgin. Papermaking stocks increasingly contain significant percentages of such recycled fibers which must be supported by the mesh of the fabric upon which they are deposited if they are to provide benefit in the papermaking process. Increased support for the papermaking fibers can only be provided by decreasing the cross-section area of the yarns from which the fabric is woven, and increasing the mesh (i.e. the density or number of yarns in each fabric direction). A fine mesh will provide more support points for the papermaking fibers, but a fine mesh will also result in a woven structure that is less rugged than a comparable fabric that is woven using larger yarns. Thus, the use of finer yarns in these fabrics has resulted in thinner fabric structures which are less mechanically stable and have reduced wear capability, leading to the need to find other means of providing the required stability and wear capability.

A further problem common to all papermaking machines and which can have an adverse effect on the formation properties of the web is the problem of "impingement drainage", i.e. the drainage of excessive amounts of the stock into or through the moving forming fabric at or close to the point of impingement on the fabric, as discussed below.

In the initial portion of the forming section (either with or without an initial open surface portion), an unsupported jet of highly aqueous stock is ejected at high speed from the head box slice onto the open PS surface of a moving forming fabric, or into the more or less convergent wedge shaped space between two moving forming fabrics in the case of a twin wire former. The jet will typically traverse a short distance before impinging the PS surface of the forming fabric, or fabrics, at the point of impingement. The angle of impingement formed between the linear axis of the stock jet and the PS surface of the forming fabric, or fabrics, on which paper is made is generally quite small. In Fourdrinier machines, the angle was typically up to about 4°' but up to about 6° for blade gap formers, and in modern roll gap formers, the angle may be up to about 10°. Since the angle of impingement cannot be zero, i.e. tangential to the fabric surface, or fabric surfaces in a twin fabric paper making machine, at least in part because the stock jet widens in the direction perpendicular to the fabric surface or surfaces in the space between the head box slice and the point of impingement, the pressure exerted by the stock jet onto the forming fabric or fabrics can be resolved into two components: a component essentially tangential to the fabric surface, and a component essentially perpendicular to the fabric surface, both of which when combined have a considerable effect on impingement drainage rates.

This problem of impingement drainage, and the particularly increased significance in relation to machines operated at higher speeds and with a greater angle of impingement, is discussed in Danby, Roger and Dale Johnson, Float Forming, Proceedings, PAPTAC 92$^{nd}$ Annual Meeting 2006, Montreal, QC, February 2006, pp. C141-C148.

As noted by those authors, the higher the angle of impingement, the greater will be the impingement velocity. These forces are directly proportional to the speed at which the forming fabric moves in the machine direction: i.e. as the machine speed increases so do the impingement forces. A further factor which affects the impingement characteristics is the mechanical geometry of the papermaking machine itself. As noted above, modern roll formers which are used on newer papermaking machines have greater impingement angles than in most previously used forming section constructions, and thus greater impingement velocities, which in turn lead to problems including poorer fines retention, sheet embedment, and generally reduced quality of formation.

In modern high speed papermaking machines in which the forming fabric(s) can be moving at speeds of 100 kph, or more, the minor pressure component perpendicular to the fabric surface exerts a significant level of force on the forming fabric, which can cause excessive impingement derived drainage of the stock over the initial portion of the forming section. This pressure component (the "impingement pressure"), which is minor on some machines but of increasing significance in many newer machines, and the turbulent forces created by stationary drainage elements, combined with the increased use of particulate fillers and shorter papermaking fibres, have the undesirable effect of reducing first pass retention and increasing the embedment of the initial layers of the embryonic web into the paper side surface of the forming fabric.

It is well known that, on any papermaking machine under start up conditions and delivering a normal papermaking volume of water but without papermaking fibers from the headbox slice onto the forming fabric, this water will drain within a very short distance, approximately 12 inches (30 cm), or less than 1% of the total available drainage length of the typical forming section. This indicates that, without fibers, all forming fabrics have far in excess of the drainage capacity required to make paper. However, as soon as papermaking fibers are introduced, drainage is retarded at a rate determined by the length of the fibers, the quantity of fibers, the support characteristics of the papermaking surface of the forming fabric, and by the forces resisting and retarding impingement drainage. It was for this reason that the original forming boards installed on open surface Fourdrinier type papermaking machines were so successful. In some more modern twin wire formers such as gap formers, the impingement shoe serves that function. However, impingement shoes cannot be used in roll formers, due to the lack of space resulting from their mechanical configuration. This is a significant problem, in that the majority of new machines are roll formers.

It is also well known that impingement drainage can cause sheet marking, low retention by the forming fabric of papermaking fibres, fines and fillers (i.e. low first pass retention), and plugging (i.e. sheet sealing) of the paper side layer of the forming fabric. Unless the structure of the forming fabric is designed to allow it to manage and control impingement drainage, further increases in machine speed and/or paper making machine efficiency may be limited or, in the case of gap formers, tied directly to improvements in forming shoe or forming board construction.

Similarly, for other industrial filtration purposes as noted above, impingement drainage will have adverse effects on the efficiency of the filtration fabric in achieving the particular purpose for which it is being used. The shorter the fibers, and the lower the fiber support from the fabric, the lower the filtration efficiency.

The future demands of the paper industry will undoubtedly be towards ever lighter basis weight sheets which will be required to be made with ever decreasing fiber lengths due to recycling, at much greater paper machine speeds in order to reduce manufacturing costs. In order to achieve this, finer papermaking fabric structures will be required than are currently available, which will be woven or otherwise assembled using yarns of increasingly smaller cross-sectional area. The resulting fabric structures will be thinner and less stable than those woven using relatively larger size yarns. If such increases in paper machine speeds and the mechanical design of the newer high speed paper machines are to be accommodated, this will require much greater fabric stability, especially in the cross machine direction, in order to produce a uniform basis weight sheet of paper.

There is therefore a need for fabric weave designs to meet these new requirements, and the problems of decreased fiber lengths, and to overcome the disadvantages, discussed above, of the use of finer yarns.

DISCUSSION OF THE PRIOR ART

These competing needs have been recognized by the manufacturers of papermaking fabrics and attempts have been made to address them in various ways.

It is known, from Seabrook et al. in U.S. Pat. No. 5,826,627 and Barrett et al. in U.S. Pat. No. 6,334,467 to use pairs of intrinsic weft binder yarns to provide a very fine paper side mesh bound to a relatively rugged and stable machine contacting structure, the fabrics also including two layers of weft yarns, one located on the paper side surface of the fabric, the other located on the machine side surface.

It is also known, from Johnson et al. in U.S. Pat. No. 6,202,705; Stone et al. in U.S. Pat. No. 6,240,973; Johnson et al. in U.S. Pat. No. 6,581,645; and Stone in U.S. Pat. No. 7,108,020 to use groupings of three warp yarns (triplets) to bind together the two weft layers of the paper and machine side surfaces. Similarly, it is known from Danby et al. in U.S. Pat. No. 7,426,944 to use pairs of warp yarns for binding the two layers of weft yarns. In the fabrics of each of these references, the warp yarns of each group of two or three yarns together form a single combined path on the paper side surface of the fabric.

It is also known to provide three layers of weft yarns, bound together in various manners by the warp yarns. For example, Tsuneo in U.S. Pat. No. 4,640,741 discloses a papermakers forming fabric including two layers of warp yarns interwoven with three layers of weft yarns, in which the upper layer of warp yarns interweaves with the yarns in the upper and intermediate layer of weft yarns, while the lower layer of warp yarns interweaves with the yarns of the lower and intermediate layer of weft yarns. The two layers of warp yarns are arranged singly, i.e. not in a group such as pairs or triplets, and do not interweave concurrently with the same intermediate layer weft yarns. Further, the reference does not teach any manner in which it would be feasible to obtain a plain weave paper side surface, which is particularly advantageous for the purposes of producing a high quality paper sheet. It is known that a plain weave paper side surface structure provides the highest possible level of fiber support in a woven structure which, in papermaking situations where shorter fibers are included in the stock, will optimize retention.

Similarly, Westerkamp in U.S. Pat. No. 6,530,398 discloses a triple weft layer forming fabric including an upper fabric layer, a lower fabric layer and an additional layer located in between the two so as to increase void volume and CD stiffness. The warp yarns are arranged singly, the paper side layer warp yarns following a steep path in their transition from the paper side to the intermediate layer; the warp yarns of the upper and lower layers do not interlace with the same intermediate layer wefts; and the binder yarns are weft yarns.

It is also known to use three layers of weft yarns, bound together by a single warp yarn system; for example, Rougvie et al. in U.S. Pat. No. 7,008,512; Fleischer in U.S. Pat. No. 5,169,709; Taipale in U.S. Pat. No. 4,941,514; and MacBean in U.S. Pat. No. 4,379,735. None of these references teaches any possible grouping of the warp yarns, nor teach any manner in which it would be feasible to obtain a plain weave paper side surface.

It is also known, from Kovar in U.S. Pat. No. 5,358,014, to provide a 14-shed extra support forming fabric, in which every $4^{th}$ weft yarn in the upper (paper side) layer, every $2^{nd}$ in the middle layer, and all in the machine side (machine side) layer form a yarn group that is held together by a warp yarn passing through the upper two layers, and other warps passing through all three layers.

It is further known from Danby et al. in U.S. Pat. No. 7,426,944 that improvements in drainage properties can be achieved, particularly to reduce the adverse effects of high impingement velocities, associated with the introduction of more modern very high speed roll formers, on impingement drainage, by weave patterns which provide for a high level of resistance in a centre plane of a fabric, i.e. a notional plane between the paper side layer and the machine side layer, and substantially parallel to the paper side layer. This increased centre plane resistance (CPR) can advantageously be provided by longer internal yarn floats between the layers, thus providing increased yarn presence in the single centre plane, as discussed further by Danby and Johnson, op cit., supra.

It has now been found that a triple weft layer type forming fabric, in which at least the warp yarns on the paper side surface are arranged in groups, e.g. pairs or triplets, can be provided in a fabric having a very rugged and stable machine side surface in combination with a very fine, preferably plain weave, paper side surface, which will provide a high number of fiber support points to optimize sheet formation. The individual yarns of the paper side warp groups, i.e. the pairs or triplets, are interwoven in a single combined path, so as to complement one another, each yarn member following the other to form the "unbroken" paper side layer weave pattern, and each in turn individually passing down to the intermediate layer to interlace with an intermediate weft yarn.

It has further been found that it is particularly advantageous if the interweaving points of the individual paper side warp yarns with an intermediate weft yarn coincide with each and every location at which a machine side layer warp yarn interlaces with the same intermediate weft yarn, so that the warp yarns of the paper and machine side layers each wrap, or turn, about the same intermediate layer weft, a feature nowhere disclosed by the prior art.

As noted above, Danby et al. in U.S. Pat. No. 7,426,944 shows the use of warp yarns to enhance drainage resistance in a single centre plane. In the fabrics of the present invention, two distinct centre planes can be identified, each substantially parallel with the plane of the paper side surface, i.e. a first notional centre plane between the paper side layer and the plane through the intermediate weft yarns; and a second notional centre plane between the machine side layer and the plane through the intermediate weft yarns. The existence and cooperation of these two centre planes further augments the resistance of the fabrics to drainage. The centre plane resistance (CPR) need not be the same in each of the two centre planes, and will depend on the weave pattern selected.

The weave patterns of the invention address the problems of the prior art, including those discussed above, by providing the following, among other, advantages.

Because the paper and machine side layer weave patterns are completely distinct from one another, the fabric designer has significantly greater freedom in selecting designs for each of the surfaces of the fabric, to meet the specific requirements of the intended end use of the fabric. For example, for a forming fabric for high quality paper, the conflicting objectives of providing a very fine mesh paper side surface and a very rugged machine side surface can be reconciled and simultaneously accomplished by introducing the third (intermediate) layer of weft yarns.

If the weft yarns in the intermediate layer in the center of the fabric are used as turning points for the warp yarns, i.e. by concurrently interweaving at each point a paper side and a machine side layer warp yarn, further strength and stability is provided to the fabric.

Similarly, the fact that the paper and machine side layer weave patterns are completely distinct also allows for the use of different materials for the warp yarns of the two layers, or different cross-sectional configurations.

The use of groups of warp yarns, combined as e.g. pairs or triplets, allows for a plain weave pattern for the paper side layer. Further, when one member of the pair or group is weaving as a plain weave on the paper side surface, the other yarn or yarns float within the respective one of the first or second center plane, before and after tying into an intermediate weft yarn, providing an advantageous CPR, thereby reducing impingement drainage through the fabric.

The machine side layer warp yarns can be coarser (i.e. have a larger cross-sectional area) than those on the paper side surface. Further, depending on the intended end use of the fabric, weave patterns for the machine side layer can readily provide for the machine side layer warp yarns to be woven as groups, e.g. pairs or triplets, without requiring any modification of the preferred weave patterns for the paper side layer. Thus the fabrics of the invention can be woven to combine the pairs or triplets of the paper side layer with any desirable weave pattern for the machine side layer yarns, as individual yarns, or grouped as pairs or triplets.

The materials for the yarns for the fabrics of the invention can be selected from any known materials suitable for use in industrial textiles of this type, and based on the intended end use of the fabric. The yarns can be monofilaments or multifilaments, shaped with any suitable cross-sectional configuration. Optionally, the intermediate weft yarns can be flocked yarns, and some of the intermediate yarns can be constructed of stainless steel. Most importantly, as the yarns of each of the paper side and machine side layers do not pass into the other layer, the usual need for compatibility between the materials in both layers does not arise, so that a very broad range of materials, dimensions and configurations can be used, in order to maximize the characteristics of the particular yarns in the locations in which they are woven.

As used herein, the following terms have the following meanings:

CD Support Length (mm/mm$^2$ or in/in$^2$): a measure of the amount of CD oriented yarn per unit area exposed on the PS of the fabric and available to support the papermaking fibers. This is based on the supporting portion which is in the PS surface, so is not affected by the diameter of the yarns.

CD/MD Support Ratio: the ratio of the CD Support Length to the MD Support Length. Fabrics having relatively higher CD/MD Support Ratios will provide better support for the generally MD oriented fibers in the papermaking stock.

Cross-Machine Direction (CD): the direction perpendicular to, and in the same plane as, the MD, i.e. across the web.

Center Plane: a notional plane through a layer of the fabric that is located between and substantially parallel to the PS and MS surfaces. In the fabrics of the invention, which are woven using three layers of weft yarns and at least two systems of warp yarns, each system of which is interwoven with two layers of weft yarns, each of the PS and MS layers will have a center plane each of which is parallel to the PS and MS surfaces.

Center Plane Resistance (CPR): the quantity of "straight through" (i.e.: from PS to MS) continuous drainage openings in one repeat of the weave pattern of a fabric, expressed as a percentage of the entire surface area. It is a measure of the resistance to fluid drainage through a notional center plane in a fabric parallel to the PS and MS caused by the presence of the interwoven component yarns (reference is made to Danby et al. U.S. Pat. No. 7,426,944 in this regard). Fabrics according to the present invention have two distinct centre planes, each having its own CPR, one in each of the machine side layer and paper side layer, due to the novel fabric structure in which the warp yarns of each layer are interwoven with the weft yarns of that layer plus intermediate wefts between the two layers. This causes the warp and weft in each layer to be offset from one another, thus obscuring any orifices that would otherwise be open directly through from the PS to the MS layers. The vast majority of drainage openings through the fabrics of this invention are offset and thus diagonal through the fabric.

Fiber Support Index (F.S.I.): a number which quantifies the support for the sheet provided by a fabric, taking into account the support length of the surface of the yarns on which the sheet of paper is formed, with emphasis on CD support. The number, for which no units are normally given or used, is calculated according to the method described by Beran and summarized in Danby, R. & Perrault, J., "Weaves of Papermaking Wires and Forming Fabrics", Montreal, QC, PAPTAC [Pulp and Paper Technical Association of Canada], rev. May 2005, p. 2-3, and which provides a measure of the number of support points available in a given fabric weave pattern. The formula for the calculation is as follows:

$$FSI = \left(\frac{\pi}{2}\right)\left(\frac{Z}{\lambda}\right) = \left(\frac{2}{3}\right)(aN_m + 2bN_c)$$

where $\lambda$=mean fiber length $N_m$=number of MD yarns/inch $N_c$=number of CMD yarns/inch a,b=coefficients for contribution of support from MD and CDM yarns, respectively (a function of weave pattern and running orientation)

Z=average number of supports per fiber.

Experience indicates that FSI can be used to compare the support characteristics of all forming fabrics. FSI is affected by the weave pattern and mesh of the surface of the fabric on which the sheet is formed but not the yarn diameters. It does not however, give any indication of the uniformity of support lengths in either direction.

Frame: a generally rectangular or square opening in the PS of a fabric formed adjacent the intersections, and defined by the interior surfaces, of the warp and weft yarns in that surface.

Frame Count (/mm$^2$ or /in$^2$): the number of openings per unit area in the PS of a fabric formed by the interwoven warp and weft yarns.

Machine Side (MS) surface: the exposed, substantially planar surface of a fabric, which, when the fabric is in use, is oriented towards and is in contact with the various stationary and moving elements of the machine in which it is used in the sheet consolidation process. This surface is located opposite to, and substantially parallel to, the PS. The related term "machine side layer" is the thickness dimension of the interwoven warp and weft yarns which, together, form the surface of the fabric which is in contact with the web consolidation machine.

Machine Direction (MD): the direction in the web consolidation machine from the wet end to the dry end of the machine, parallel to the forward movement of the web and in the same plane as the web.

Maximum Frame Length (mm or in.): the maximum inside dimension of a frame in the MD, i.e. the distance from weft to weft in the PS of the fabric MD Support Length (mm/mm$^2$ or in./in.$^2$): a measure of the amount of MD oriented yarn per unit area exposed on the PS of the fabric and available to support the papermaking fibers. This is based on the supporting portion which is in the PS surface, so is not affected by the diameter of the yarns.

Mesh: the number of yarns that are contained within one unit length (e.g. a linear inch) of a fabric as measured in one direction (either MD or CD); the frame count will be directly influenced by the mesh. A "fine" woven fabric will have a higher mesh number than a "coarse" fabric having a comparatively lower mesh number.

Paper Side (PS) surface: the exposed, substantially planar surface of a fabric which, when the fabric is in use, is oriented towards and provides support to the web of fibers deposited thereon in the sheet consolidation process. The related term "paper side layer" is the thickness dimension of the interwoven warp and weft yarns, located so as to provide a contacting surface for the fibers.

PS Drainage Area (%): the percentage of the total area in the PS that is open and available for fluid drainage into the fabric. A fabric having a relatively high PS drainage area is said to be more "open" than one having a relatively lower amount of drainage area.

Examples showing Fiber Support Characteristics Surface Comparison

Four fabrics were woven according to the invention, as discussed further below with reference to the figures, and their characteristics were compared with those of a known fine mesh weft tied triple layer fabric of the prior art, woven according to Seabrook et al. in U.S. Pat. No. 5,826,627, and identified in each of Tables 1 to 4 below as Fabric A. Table 1 shows the comparison between four fabrics according to aspects of the invention, and the prior art Fabric A, as discussed below, in which each of the terms used has the meanings discussed above. Fabrics B to E were woven according to the invention, using three layers of weft yarns and pairs of warp yarns as shown variously in the drawings as discussed in detail below. In this Table, and in each of Tables 2 to 4 below, the various values for the features listed are stated in the units which are currently used in the industry as standard. However, applicable conversions are provided in relation to each of the features discussed in more detail in the text which follows each of the four Tables.

TABLE 1

| | A Prior Art | B 1st embodiment | C 2nd embodiment | D 3rd embodiment | E 4th embodiment |
|---|---|---|---|---|---|
| Yarn Count (1/in.) | | | | | |
| Total | 148 × 180 | 148 × 180 | 148 × 216 | 222 × 232 | 222 × 272 |
| Paper Side (PS) | 74 × 90 | 37 × 90 | 37 × 108 | 74 × 116 | 74 × 136 |
| Center plane | none × 30 | 37 + 37 × 45 | 37 + 37 × 54 | 74 + 37 × 58 | 74 + 37 × 68 |
| Machine Side (MS) | 74 × 60 | 37 × 45 | 37 × 54 | 37 × 58 | 37 × 68 |
| Yarn Diameters (mm) | | | | | |
| PS/MD | 0.13 | 0.13 | 0.13 | 0.10 | 0.09 |
| MS/MD | 0.21 | 0.21 | 0.21 | 0.21 | 0.21 |
| PS/Cross Direction (CD) | 0.14 | 0.14 | 0.14 | 0.10 | 0.09 |
| Center Plane CD | none | 0.17 | 0.17 | 0.17 | 0.17 |
| MS/CD | 0.30 | 0.30 | 0.30 | 0.30 | 0.30 |
| Fabric Characteristics | | | | | |
| PS Drainage Area (%) | 31.3 | 40.9 | 32.8 | 38.5 | 38.2 |
| Frames Count (/in.$^2$) | 6660 | 3330 | 3996 | 8584 | 10064 |
| Fibre Support Index (F.S.I.) | 169 | 145 | 169 | 204 | 231 |
| Max. Frame Length (mm) | 0.142 | 0.142 | 0.095 | 0.119 | 0.097 |
| MD Support Length (in/in$^2$) | 74.0 | 37.0 | 37.0 | 74.0 | 74.0 |
| CD Support Length (in/in$^2$) | 90.0 | 90.0 | 108.0 | 116.0 | 136.0 |
| CD/MD Support Ratio | 1.22 | 2.43 | 2.92 | 1.57 | 1.84 |

Fabric A (Prior Art)

The data for this fabric, which was constructed according to U.S. Pat. No. 5,826,627 using a plain weave PS layer design and a 6-shed broken twill MS weave design, show the paper making characteristics of the PS surface. Fabric A was woven using intrinsic weft binder yarns, and has a warp ratio of 1:1 and a weft ratio of 3:2, i.e. using pairs of warp yarns interwoven on each of the PS and MS layers (1:1 ratio), and three weft yarns in the PS layer for every two in the MS layer (3:2 ratio). This fabric has a single set of warp yarns on the paper side and a single set on the machine side, interwoven with the weft yarns to provide a paper side drainage area of about 31%, a frame count of 6660 per square inch (1032/cm$^2$), and a Fiber Support Index of 169.

Fabric B (Invention)

This example used exactly the same warps as for the prior art fabric A, but each warp yarn was paired with another warp yarn, and interwoven as intrinsic warp binder pairs. The fabric was constructed using three layers of weft yarns, one located in each of the PS, MS and intermediate fabric layers. Pairs of intrinsic warp binder yarns located on the PS layer were interwoven with the PS and intermediate layer of weft yarns to form the PS layer, while pairs of intrinsic warp binder yarns were similarly interwoven with the MS and intermediate layer of weft yarns to form the MS layer. In other words, these intrinsic warp binder yarns from each layer were all woven into weft yarns located in an intermediate layer of weft yarns according to the invention, i.e. a pair of intrinsic PS layer warp yarns will follow a single combined path, in which the two members alternate weaving into a PS layer weft and then into a center weft yarn before returning to the PS. In this example, a 1:1 warp yarn combination and a 2:1 weft yarn combination were used, i.e. using pairs of warp yarns interwoven on each of the PS and MS layers (1:1 ratio), and twice as many weft yarns in the PS layer as the MS layer (2:1 ratio). From the table, it can be seen that for this fabric, as compared with Fabric A, the effective papermaking MD yarn count on the paper side surface dropped down from 74/in. to 37/in. (29.1/ cm to 14.6/cm), which reduced the paper side surface frame count down from 6660/in.$^2$ to 3330/in.$^2$ (1032/cm$^2$ to 516/cm$^2$) and the Fiber Support Index from 169 to 145. The maximum MD frame length stayed the same at 0.142 mm (0.036 in.). The MD support length to the fiber was reduced from 74 in./in.$^2$ to 37 in./in.$^2$ ((29.1 cm/cm$^2$ to 14.6 cm/cm$^2$) while the CD support length stayed the same at 90 in./in.$^2$ (35.4 cm/cm$^2$). However, it will be noted that PS drainage area increased from 31.3% to 40.9%, or increased by 30%. This significant increase would improve the dryness of the sheet leaving the couch which in turn will reduce the energy requirements for drying.

The machine side pair of intrinsic warps are woven into both the machine side and center wefts, which has the effect of reducing the number of warp yarns on the machine side surface at any one time; in this case the reduction was from 74/in. to 37/in. (29.1/cm to 14.6/cm). The center weft is the turning point around which both the paper side and machine side warps change their direction, which results in a desirable increase in the number of warp yarns in this center plane.

Fabric C

This example shows that it is possible to increase the PS drainage area while increasing the CD support length so as to provide additional support to the MD oriented papermaking fibers. In this example, the diameter of the warp and the weft yarns remained unchanged from those of Fabrics A and B. However, the paper side surface CD weft count was increased to 108/in. (42.5/cm), which had the effect of reducing the PS drainage area to 32.8% from 40.9%, increased the FSI back up to 169, increased the frame count to 3996/in.$^2$ (619/cm$^2$) but not up to the original 6660/in.$^2$ ((1032/cm$^2$) of Fabric A. However, the maximum frame length for supporting the MD oriented papermaking fibers was reduced significantly from 0.142 to 0.095 mm (0.0056 in. to 0.0037 in.). The MD support length remained the same at 37 in./in.$^2$ (14.6 cm/cm$^2$) but the CD support length increased from 90 in./in.$^2$ to 108 in./in.$^2$ ((35.4 cm/cm$^2$ to 42.5 cm/cm$^2$) and the ratio of CD to MD support increased to 2.43 which is advantageous because of the bias of MD predominance of fiber in the stock slurry as it falls onto the surface of the forming fabric.

Fabric D

This example shows that by using the center weft as a turning point, the two conflicting requirements of a forming fabric (very fine paper side surface for paper making and coarse machine side surface for mechanical stability and durability) can be more readily reconciled. In this example the paper side surface warp count was doubled in comparison to each of Fabrics B and C, and the diameter of both warp and weft yarns in the paper side surface was reduced in comparison to Fabrics A, B and C thus providing for finer MD and CD yarns on the paper side surface, without changing the coarse yarns on the machine side for mechanical stability and wear volume so as to provide a very fine but open paper side surface on a stable base. As a result of these changes, it can be seen that the frame count in Fabric D was increased to 8584/in$^2$ (1331/cm$^2$) compared to 6660/in.$^2$ for Fabric A, the Fiber Support Index was increased to 204 compared to 169, the highly important MD frame length was reduced to 0.119 mm (0.0048 in.) compared to 0.142 mm (0.0056 in.) for fabric A, the MD support length remained the same at 74 in./in.$^2$ (29 cm/cm$^2$) but the CD support length increased to 116 in./in.$^2$ (45.7 cm/cm$^2$) compared to 90 in./in.$^2$ (35.4 cm/cm$^2$) for both Fabrics A and B. These considerable improvements in supporting and filtering the fiber were achieved without reducing the paper side surface drainage area as can be seen by examination of Table 1. Data presented there shows that the paper side surface drainage area of Fabric D was 38.5% compared to 31.3% for Fabric A. Thus when compared to the prior art Fabric A, it can be seen that Fabric D provides a finer PS mesh, with more drainage area and MD support, a very high predominance of CD support at 116 in./in$^2$ (45 cm/cm$^2$) and a much improved support ratio of 1.57:1 in comparison to 1.22:1.

Fabric E

In this fourth embodiment of a fabric woven according to the teachings of the present invention, it is shown that it is possible to achieve an even finer mesh paper making surface through the use of even smaller diameter warp and weft yarns while increasing the weft yarn count, resulting in a very fine, yet open paper side surface. Fabric E was woven using 0.09 mm (0.0035 in.) diameter monofilament warp and weft yarns in the paper side layer, approximately 30% smaller than the yarns used in the prior art Fabric A. This increased the fabric FSI from 169 for Fabric A to 231 for Fabric E, and would not have produced a workable fabric if constructed according to prior art teachings. This is because the center plane of weft yarns in the fabrics of this invention allow for a more rugged machine side layer platform to be attached to the very fine mesh paper side layer as described in these embodiments.

The fine mesh, open paper side layer fabric structure of Fabric E provides the advantages of increased first pass retention, which is particularly significant in light of the shorter fiber lengths currently encountered in paper manufacture due to increased use of recycle fiber content, and produces a sheet which has greater uniformity than has previously been possible to allow for print quality improvements. This fine paper side surface structure will also provide greater fiber and paper machine efficiencies. The ability to maintain the original coarse machine side structure means that there is no reduction in expected fabric life and stability. These two opposing properties of the fabric are separated, but connected, by the introduction of the center weft yarns which tie the paper side and machine side warp together.

In the fabrics of the invention, exemplified above in Table 1 and in Tables 2 to 4 below, it is demonstrated that it is now possible to modify and improve the desirable characteristics in the paper side surface, without sacrificing stability or durability in the machine side layer and of the total fabric. These important advantages are discussed further below, following the description of the fabrics exemplified in Table 4.

Tables 2, 3 and 4 below show structure and properties for exemplary fabrics for three distinct groups of end products, each having different fabric characteristics and requirements. Table 2 shows these factors for fabrics intended for use in the manufacture of brown paper and similar heavier basis weight paper grades; Table 3 shows these factors for finer paper grades; and Table 4 shows these factors for super-fine paper grades.

TABLE 2

| | A Prior Art | B 1st embodiment | C 2nd embodiment | D 3rd embodiment | E 4th embodiment |
|---|---|---|---|---|---|
| Yarn Count (1/in.) | | | | | |
| Total | 128 × 108 | 128 × 108 | 128 × 152 | 192 × 140 | 192 × 172 |
| Paper Side (PS) | 64 × 54 | 32 × 54 | 32 × 76 | 64 × 70 | 64 × 86 |
| Center plane | none × 18 | 32 + 32 × 27 | 32 + 32 × 38 | 64 + 32 × 35 | 64 + 32 × 43 |
| Machine Side (MS) | 64 × 36 | 32 × 27 | 32 × 38 | 32 × 35 | 32 × 43 |
| Yarn Diameters (mm) | | | | | |
| PS/MD | 0.20 | 0.20 | 0.20 | 0.15 | 0.13 |
| MS/MD | 0.27 | 0.27 | 0.27 | 0.27 | 0.27 |
| PS/Cross Direction (CD) | 0.19 | 0.19 | 0.19 | 0.15 | 0.13 |
| Center Plane CD | none | 0.19 | 0.19 | 0.19 | 0.19 |
| MS/CD | 0.35 | 0.35 | 0.35 | 0.35 | 0.35 |
| Fabric Characteristics | | | | | |
| PS Drainage Area (%) | 29.6 | 44.6 | 32.3 | 36.5 | 37.6 |
| Frames Count (/in.$^2$) | 3456 | 1728 | 2432 | 4480 | 5504 |
| Fibre Support Index (F.S.I.) | 115 | 93 | 123 | 136 | 157 |
| Max. Frame Length (mm) | 0.280 | 0.280 | 0.144 | 0.213 | 0.165 |
| MD Support Length (in/in$^2$) | 64.0 | 32.0 | 32.0 | 64.0 | 64.0 |
| CD Support Length (in/in$^2$) | 54.0 | 54.0 | 76.0 | 70.0 | 86.0 |
| CD/MD Support Ratio | 0.84 | 1.69 | 2.38 | 1.09 | 1.34 |

TABLE 3

| | A Prior Art | B 1st embodiment | C 2nd embodiment | D 3rd embodiment | E 4th embodiment |
|---|---|---|---|---|---|
| Yarn Count (1/in.) | | | | | |
| Total | 180 × 180 | 180 × 180 | 180 × 220 | 270 × 252 | 270 × 300 |
| Paper Side (PS) | 90 × 90 | 45 × 90 | 45 × 110 | 90 × 126 | 90 × 150 |
| Center plane | none × 30 | 45 + 45 × 45 | 45 + 45 × 55 | 90 + 45 × 63 | 90 + 45 × 75 |
| Machine Side (MS) | 90 × 60 | 45 × 45 | 45 × 55 | 45 × 63 | 45 × 75 |
| Yarn Diameters (mm) | | | | | |
| PS/MD | 0.13 | 0.13 | 0.13 | 0.10 | 0.09 |
| MS/MD | 0.17 | 0.17 | 0.17 | 0.17 | 0.17 |
| PS/Cross Direction (CD) | 0.13 | 0.13 | 0.13 | 0.10 | 0.09 |
| Center Plane CD | none | 0.17 | 0.17 | 0.15 | 0.15 |
| MS/CD | 0.25 | 0.25 | 0.25 | 0.25 | 0.25 |
| Fabric Characteristics | | | | | |
| PS Drainage Area (%) | 29.1 | 41.5 | 33.6 | 32.5 | 31.9 |
| Frames Count (/in.$^2$) | 8100 | 4050 | 4950 | 11340 | 13500 |
| Fibre Support Index (F.S.I.) | 180 | 150 | 177 | 228 | 260 |
| Max. Frame Length (mm) | 0.152 | 0.152 | 0.101 | 0.102 | 0.079 |

TABLE 3-continued

| | A Prior Art | B 1st embodiment | C 2nd embodiment | D 3rd embodiment | E 4th embodiment |
|---|---|---|---|---|---|
| MD Support Length (in/in$^2$) | 90.0 | 45.0 | 45.0 | 90.0 | 90.0 |
| CD Support Length (in/in$^2$) | 90.0 | 90.0 | 110.0 | 126.0 | 150.0 |
| CD/MD Support Ratio | 1.00 | 2.00 | 2.44 | 1.40 | 1.67 |

TABLE 4

| | A Prior Art | B 1st embodiment | C 2nd embodiment | D 3rd embodiment | E 4th embodiment |
|---|---|---|---|---|---|
| Yarn Count (1/in.) | | | | | |
| Total | 204 × 200 | 204 × 200 | 102 × 272 | 204 × 204 | 204 × 264 |
| Paper Side (PS) | 102 × 100 | 51 × 100 | 51 × 136 | 102 × 102 | 102 × 132 |
| Center plane | none × 33 | 51 + 51 × 50 | 51 + 51 × 68 | 102 + 51 × 51 | 102 + 51 × 66 |
| Machine Side (MS) | 102 × 67 | 51 × 50 | 51 × 68 | 51 × 51 | 51 × 66 |
| Yarn Diameters (mm) | | | | | |
| PS/MD | 0.11 | 0.11 | 0.11 | 0.09 | 0.09 |
| MS/MD | 0.15 | 0.15 | 0.15 | 0.15 | 0.15 |
| PS/Cross Direction (CD) | 0.11 | 0.11 | 0.11 | 0.09 | 0.09 |
| Center Plane CD | none | 0.15 | 0.15 | 0.15 | 0.15 |
| MS/CD | 0.22 | 0.22 | 0.22 | 0.22 | 0.22 |
| Fabric Characteristics | | | | | |
| PS Drainage Area (%) | 31.6 | 44.2 | 32.0 | 40.8 | 34.0 |
| Frames Count (/in.$^2$) | 10200 | 5100 | 6936 | 10404 | 13464 |
| Fibre Support Index (F.S.I.) | 201 | 167 | 215 | 204 | 244 |
| Max. Frame Length (mm) | 0.144 | 0.144 | 0.077 | 0.159 | 0.102 |
| MD Support Length (in/in$^2$) | 102.0 | 51.0 | 51.0 | 102.0 | 102.0 |
| CD Support Length (in/in$^2$) | 100.0 | 100.0 | 136.0 | 102.0 | 132.0 |
| CD/MD Support Ratio | 0.98 | 1.96 | 2.67 | 1.00 | 1.29 |

In each of the embodiments presented in Tables 2 to 4, warp ratios (PS:MS) of 1:1 and 2:1 were used, and weft ratios (PS:MS) of 2:1 were employed. Each of these was selected for the purpose of demonstration and comparison only; it will be recognized by those of skill in the art that any other suitable warp and weft ratios could be used.

Similarly, in each of the examples, the diameters for the warp and weft yarns on the paper side and machine side surfaces were selected for the purpose of demonstration and comparison only, and any other suitable diameters could be used.

Further, a plain weave pattern was selected for the paper side surface, but any other suitable weave pattern could be used for either of the paper side or machine side surfaces, depending on the intended end use requirements. However, a plain weave is generally preferred for the PS where the end use requires a fine surface, e.g. for high quality printing.

The examples provided in each of Tables 1 through 4 show that, by means of the invention, it is possible to provide a very fine and open paper side surface, so as to: a) maximize both the Fiber Support Index and the drainage area of the paper side; b) adjust the MD and CD support lengths in accordance with the requirements of the papermaking environment (including the grade of sheet product to be manufactured, fiber size in the papermaking stock, and related characteristics); while providing a supporting structure in the machine side which is appropriate and optimal for the mechanical requirements of the machine on which the fabric is installed (i.e. to provide a robust machine side weave design upon which can be attached a very fine, high support paper side surface). It has been found that, by means of this invention, it is now possible to use yarns in the paper side surface which can be very small in size, down to about 0.09 mm (0.0035 in.) in diameter, or lower as suitable yarns of even smaller diameters become commercially available. It would not have been possible to use yarns of such small diameter in prior art fabrics and be able to provide a fabric capable of withstanding the paper making machine environment for an appreciable length of time.

In the fabrics of the invention, the center weft yarns act as an attachment point to which each of the paper side and machine side layer weave structures is anchored, to unite each independent weave structure into a fully interconnected fabric. Unlike the prior art fabrics in which the paper side and machine side layers are necessarily interdependent, due to the interweaving of the binder yarns between the two layers, the present invention removes the need for this interdependence, thereby allowing greater freedom to select weave designs for each layer which are optimal for the role of that layer in the specific papermaking environment. Thus although it would be possible, as shown by the fabric properties of the embodiments described in Tables 1 to 4, to provide a fine paper side surface in such prior art fabrics, such as those described by Seabrook et al. and which are identified as Fabric A in the Tables, the resulting fabric would lack both the mechanical stability and CPR (or resistance to impingement drainage) that it is now possible to achieve in fabrics constructed according to the present invention. Thus, the invention allows for the selection from a wide range of paper side and machine side weaves, to be interconnected in the fabrics of the invention, each weave pattern having optimal properties for the papermaking environment into which the fabric will be installed, where each weave is attached to the center plane of weft at corresponding tie locations (i.e. each of the paper side and machine side weaves must tie at the same center plane weft yarn). This increased independence of the paper side and machine side layers for the fabrics of the invention thus provides both papermaking fabric manufacturers and papermakers with the ability to select a far greater variety and combination of fabric characteristics than has previously been possible without the corresponding disadvantages.

The invention therefore seeks to provide a flat woven industrial filtration fabric, having a paper side layer with a paper side surface and a machine side layer with a machine side surface, the fabric being woven according to a first repeating weave pattern and comprising:

(a) paper side layer weft yarns;
(b) machine side layer weft yarns;
(c) intermediate weft yarns located between the paper side layer and the machine side layer;
(d) first warp yarns; and
(e) second warp yarns, wherein:

(i) the first warp yarns comprise groups of at least two members and are interwoven with the paper side layer weft yarns and the intermediate weft yarns according to a second repeating weave pattern wherein the members of each group together form a single combined path on the paper side surface of the fabric, and
(ii) the second warp yarns are interwoven with the machine side layer weft yarns and the intermediate weft yarns according to a third repeating weave pattern.

Preferably, at each location at which a first warp yarn interweaves with an intermediate weft yarn, a second warp yarn interweaves with the same intermediate weft yarn, and at each location at which a second warp yarn interweaves with an intermediate weft yarn, a first warp yarn interweaves with the same intermediate weft yarn.

Preferably, the fabric is woven using at least 12 sheds in the loom, more preferably 24 sheds or multiples thereof, which enables the weaving of combinations of plain and 2×1 weave PS layer surfaces; in which case the machine side layer can be woven in any weave pattern that is feasible with 24 sheds—i.e. 2, 3, 4, 6, 8 or 12 shed weave patterns.

Preferably, the yarn diameters are substantially as shown in Table 1, but can be higher or lower, depending on the intended end use of the fabric.

The high center plane resistance fabrics of the invention can also be woven using equal CD yarn counts in all three layers; or using equal CD yarn counts in the paper side layer and the intermediate layer, with a yarn count of one/half in the machine side layer.

BRIEF DESCRIPTION OF THE DRAWINGS

The invention will now be described in relation to the drawings, in which

FIG. 6A is a weave diagram of a fabric in a third embodiment of the invention;

DETAILED DESCRIPTION OF THE DRAWINGS

Figure 1:
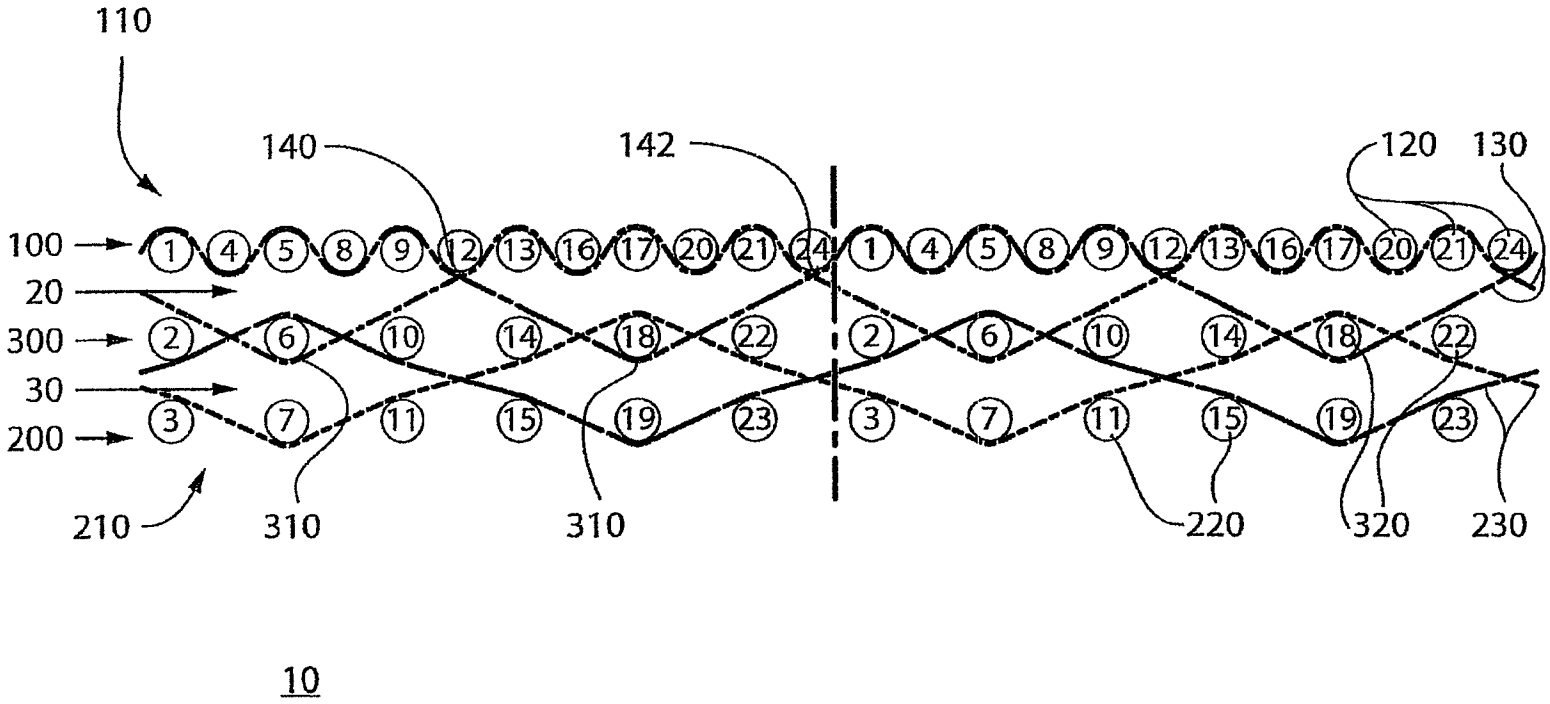
FIG. 1 shows the warp yarn paths in two repeats of the weave pattern of a fabric in a first embodiment of the invention, in which the upper warp yarns comprise pairs and the lower warp yarns comprise pairs.
Figure 2A:
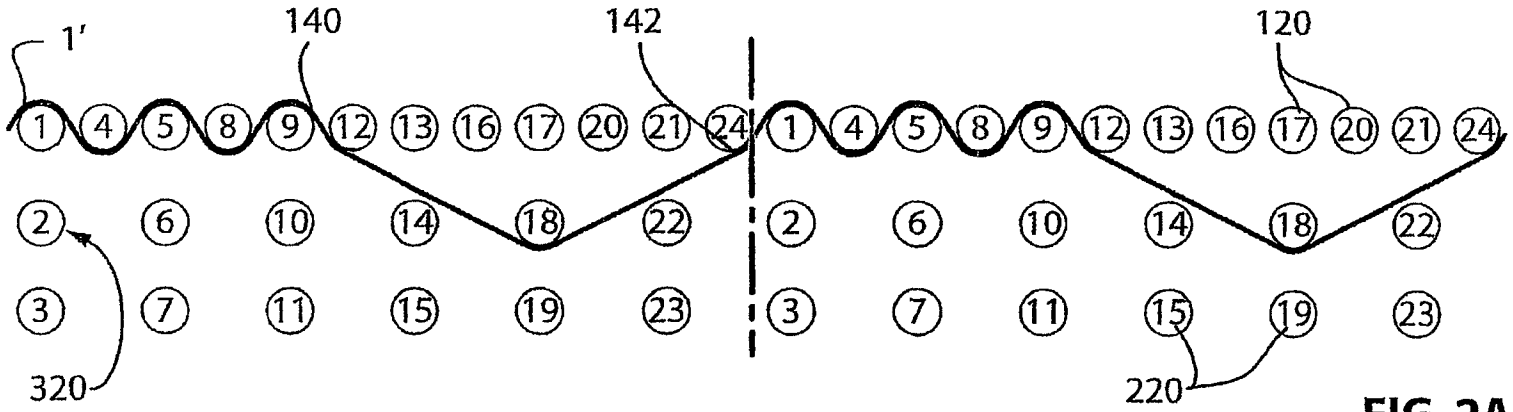
FIGS. 2A to 2D show two repeats of the respective individual paths of two upper warp yarns and two lower warp yarns in the embodiment shown in FIG. 1.
Figure 2B:
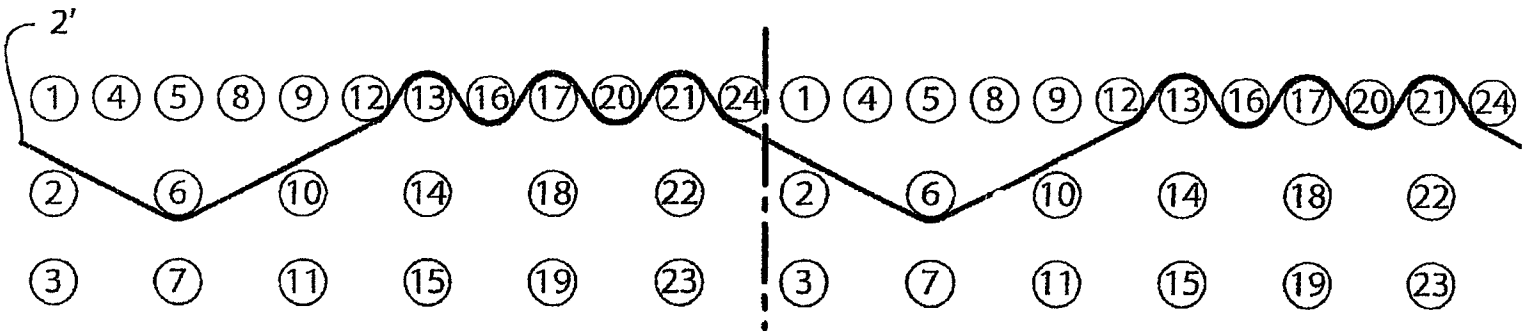
Figure 2C:
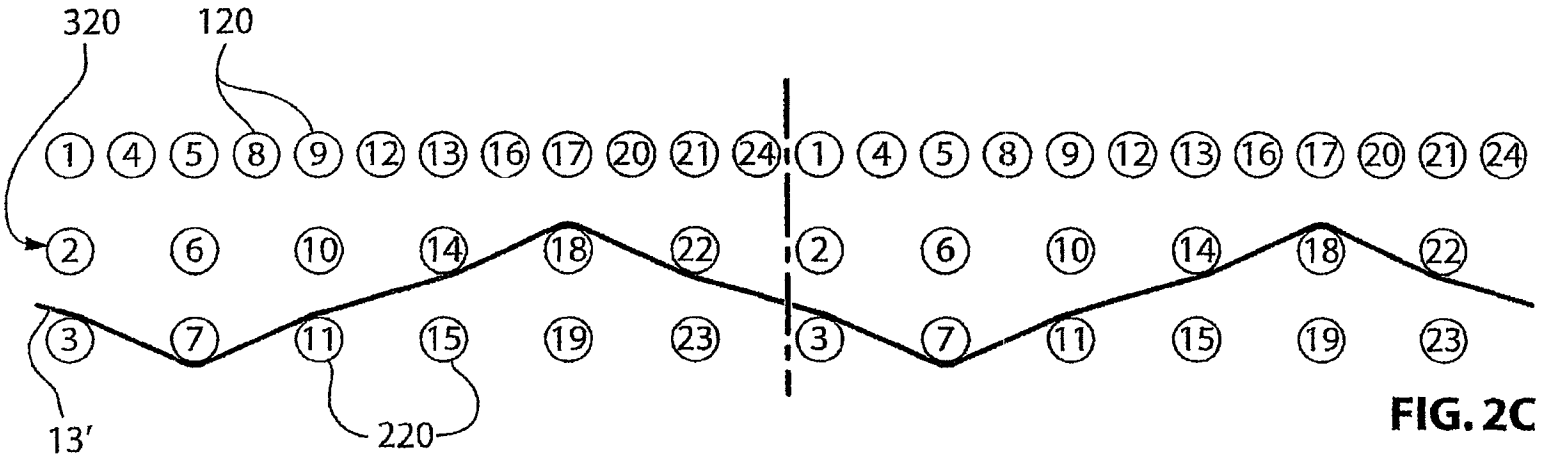
Figure 2D:
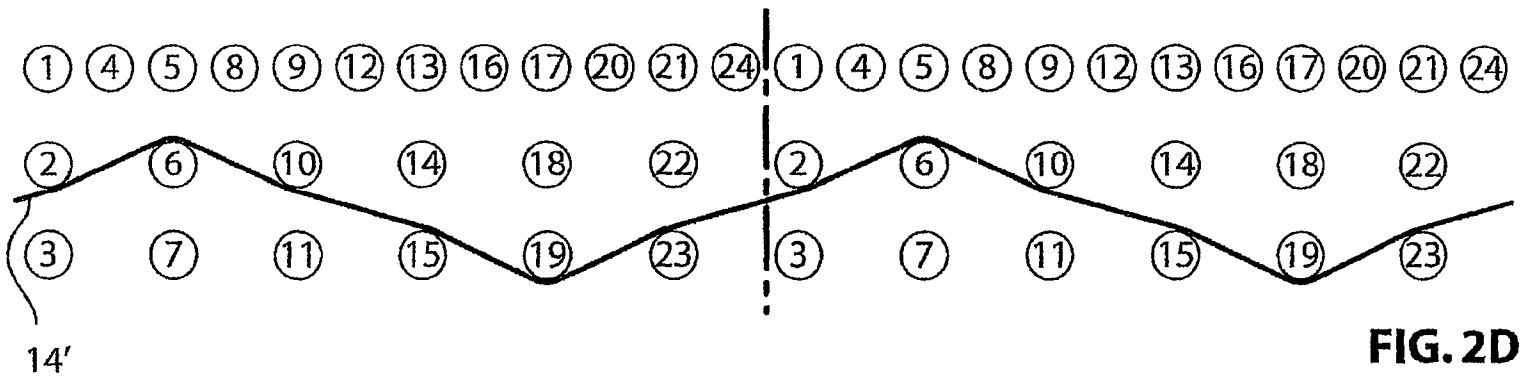
Figure 3:
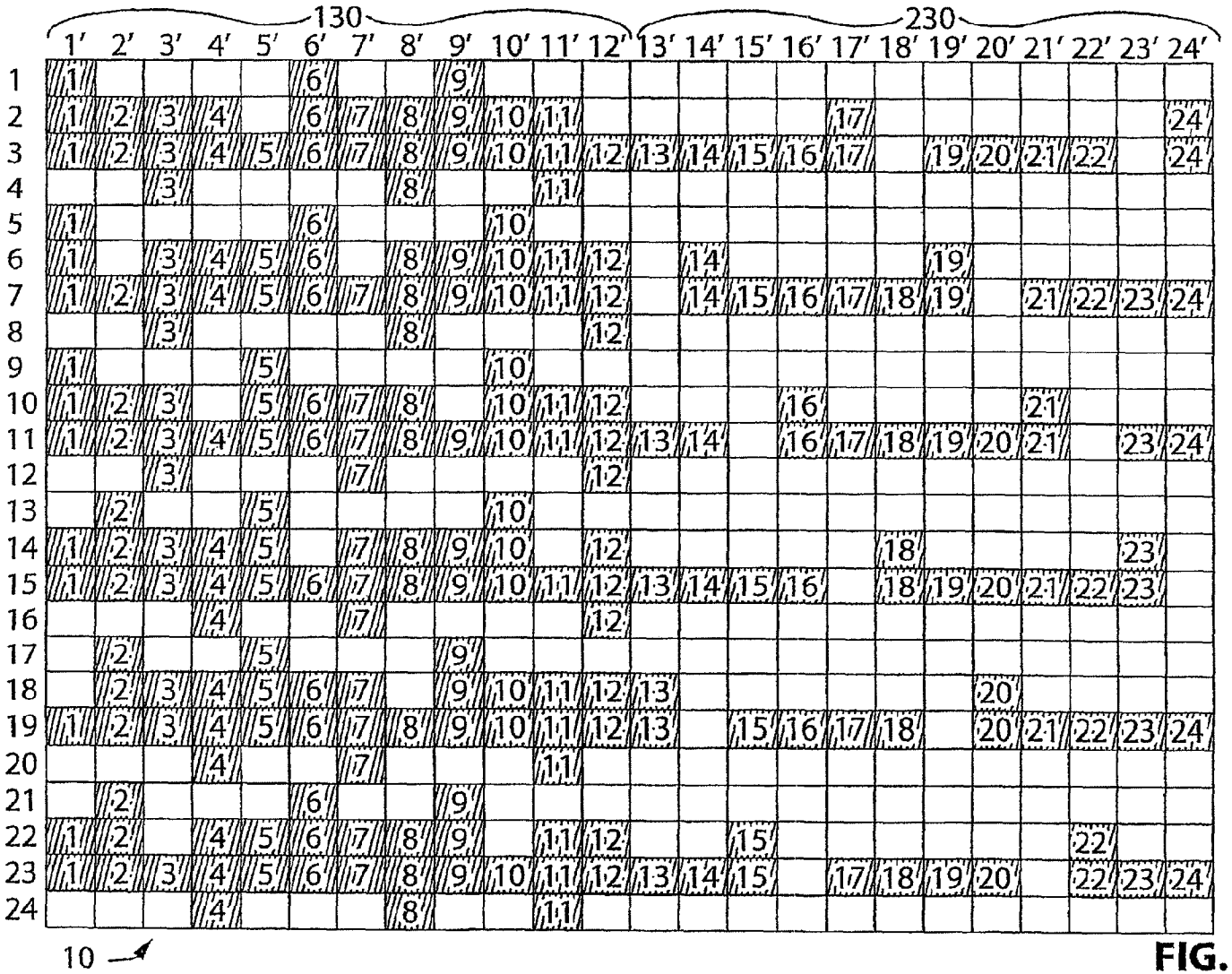
FIG. 3 is a weave diagram of the fabric of FIG. 1.

Referring to FIGS. 1 to 3, a fabric 10 of a first embodiment of the invention has a PS layer 100 having an exposed PS surface 110, and an MS layer 200 having an exposed MS surface 210. The PS layer 100 comprises PS layer weft yarns 120, numbered individually in each of FIGS. 1 to 3 as 1, 4, 5, 8, 9, 12, 13, 16, 17, 20, 21 and 24, and interwoven with PS warp yarns 130. The MS layer 200 comprises MS layer weft yarns 220, numbered individually in each of FIGS. 1 to 3 as 3, 7, 11, 15, 19 and 23. Between the PS layer 100 and the MS layer 200, an intermediate layer 300 is provided by a set of intermediate weft yarns 320, which are numbered individually in each of FIGS. 1 to 3 as 2, 6, 10, 14, 18 and 22, and are interwoven with each of the PS warp yarns 130 and the MS warp yarns 230, to bind the fabric layers together as discussed further below.

In this embodiment, the PS warp yarns 130 are all woven as pairs, and the MS warp yarns 230 are also woven as pairs.

FIGS. 2A and 2B show the paths of a typical pair of the PS warp yarns 130, in two repeats of the weave pattern for this embodiment, the two warp yarns being identified respectively as warp yarn 1' and warp yarn 2'. Each member of the pair alternates between the PS layer 100 and the interior of the fabric 10, the two members of the pair exchanging positions at exchange points 140, 142, seen in FIGS. 1 and 2A under PS weft yarns 12 and 24, to follow a combined single path in the PS layer 100, in this embodiment interweaving with the PS weft yarns 120 in a plain weave pattern.

Further, in each repeat of the weave pattern for the fabric 10, each member of the pair of PS warp yarns 130 interweaves once with one intermediate weft yarn 320. For example, as shown in FIG. 2A, PS warp yarn 1' interweaves with intermediate weft yarn 18, and as shown in FIG. 2B, PS warp yarn 2' interweaves with intermediate weft yarn 6.

Referring now to FIGS. 2C and 2D, the paths of a typical pair of the MS warp yarns 230 are shown, in two repeats of the weave pattern. In each repeat, the two members of the pair, shown respectively as warp yarn 13' and warp yarn 14', each interweave with one MS weft yarn 220 and one intermediate weft yarn 320. Thus, warp yarn 13', shown in FIG. 2C, interweaves with MS weft yarn 7 and intermediate weft yarn 18; and warp yarn 14', shown in FIG. 2D, interweaves with MS weft yarn 19 and intermediate weft yarn 6.

Referring again to FIG. 1, it can be seen that when the first member 1' of the pair of PS warp yarns 130 interweaves with intermediate weft yarn 18 from above, the first member 13' of the pair of MS warp yarns 230 interweaves with the same intermediate weft yarn 18 from below. Similarly, when the second member 2' of the pair of PS warp yarns interweaves with intermediate weft yarn 6 from above, the second member 14' of the pair of MS warp yarns interweaves with the same intermediate weft yarn 6 from below. This pattern in the intermediate layer, with the PS and MS warp yarns interweaving with selected intermediate weft yarns at turning weft points 310, serves to bind the layers of the fabric 10 together, without the PS warp yarns 130 ever appearing in the MS layer 200, or the MS warp yarns ever appearing in the PS layer 100.

FIG. 3 shows the weave pattern for the fabric 10, described above in relation to FIGS. 1, 2A to 2D. The warp yarns are shown vertically in the Figure, and identified across the top of the figure as warp yarns 1' to 24'. The weft yarns are shown horizontally, and numbered down the left side of the figure as weft yarns 1 to 24. In this figure, the interweaving patterns of warps 1', 2', 13' and 14', shown in FIGS. 1, 2A, 2B, 2C and 2D, are shown together with the paths of the remaining 20 warp yarns in one repeat of the overall fabric weave pattern.

Figure 4:
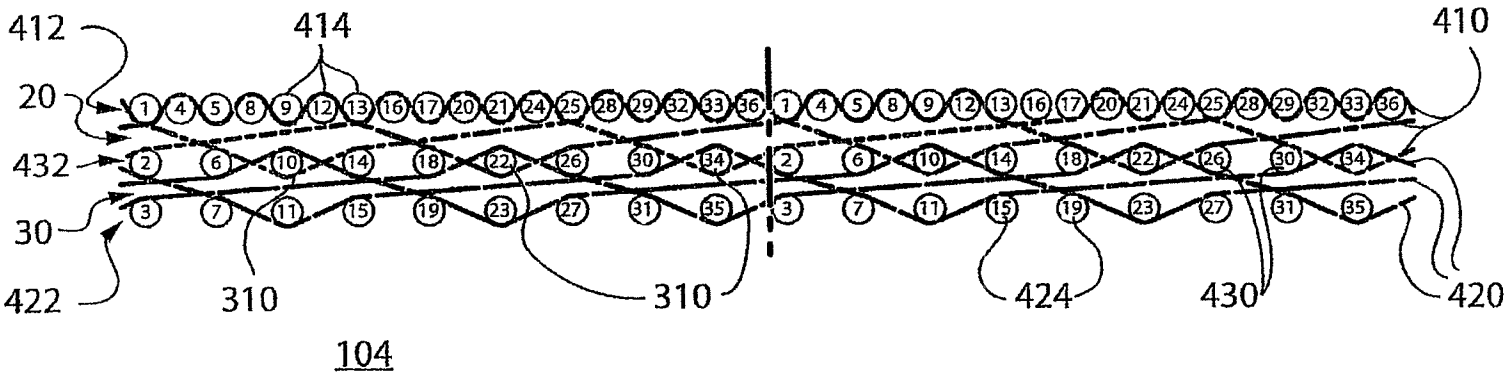
FIG. 4 shows the warp yarn paths in two repeats of the weave pattern of a fabric in a second embodiment of the invention, in which the upper warp yarns comprise triplets and the lower warp yarns comprise triplets.
Figure 5A:
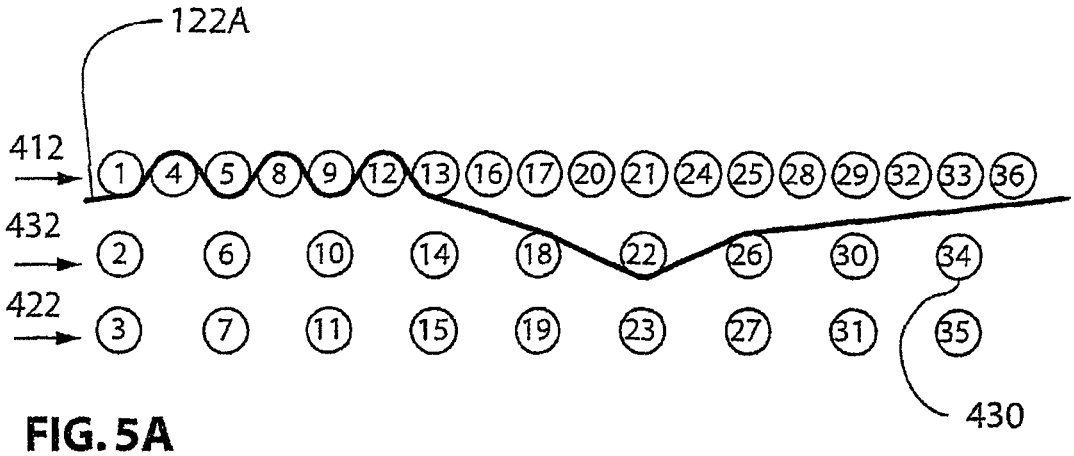
FIGS. 5A to 5F show one repeat of the respective individual paths of three upper warp yarns and three lower warp yarns in the embodiment shown in FIG. 4.
Figure 5B:
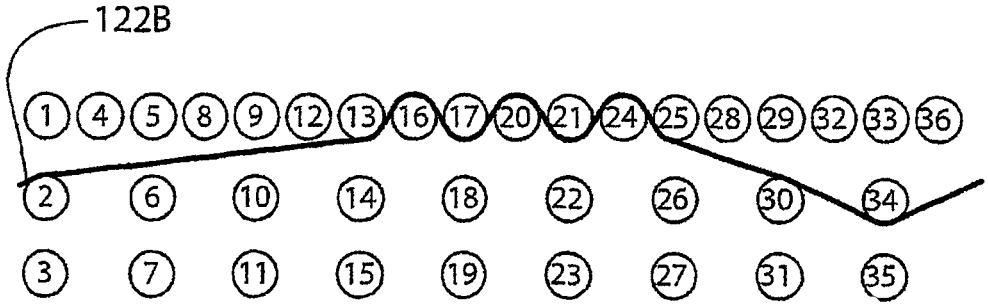
Figure 5C:
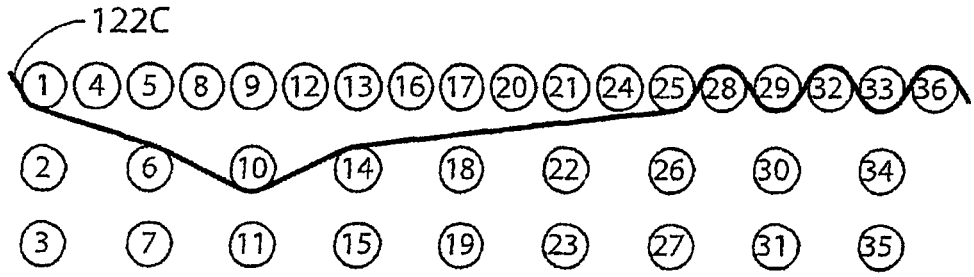
Figure 5D:
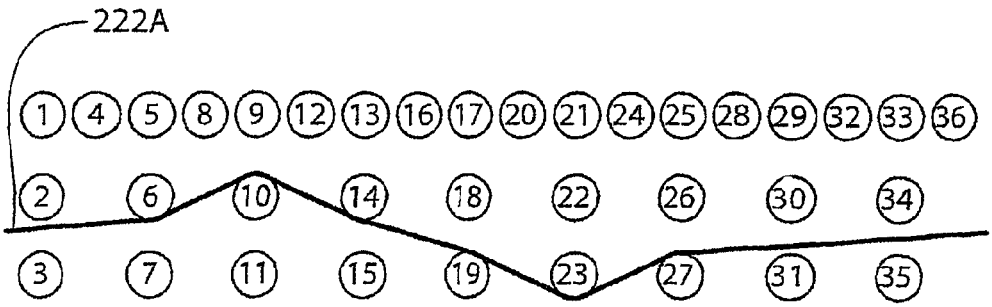
Figure 5E:
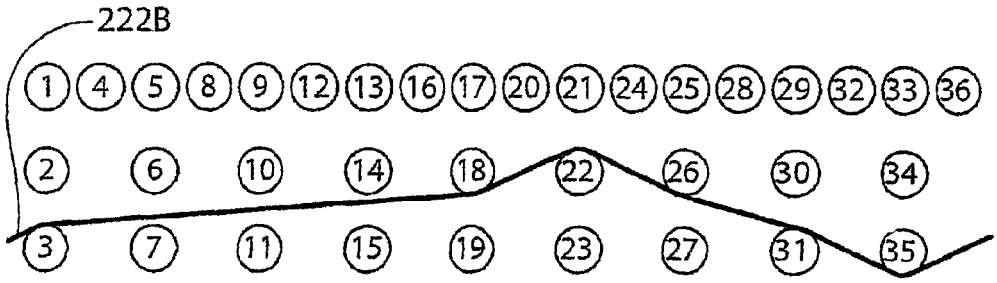
Figure 5F:
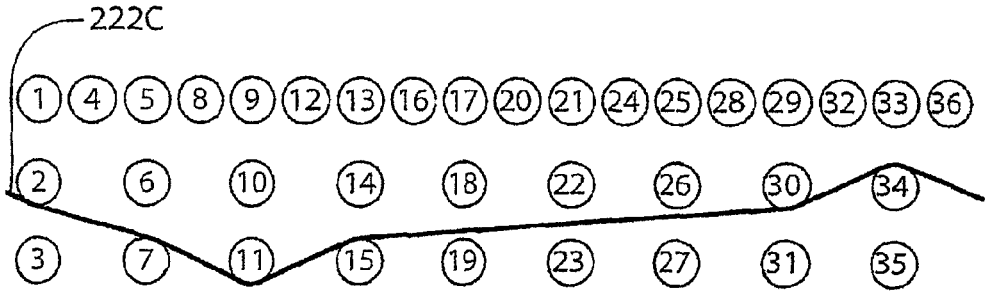

Referring now to FIGS. 4, and 5A to 5F, a fabric 104 of a second embodiment of the invention is shown, in which the PS warp yarns 410 are woven as triplets, and the MS warp yarns 420 are also woven as triplets. FIG. 4 shows two repeats of the weave pattern for fabric 104; FIGS. 5A to 5C show the respective paths of the three members of a PS triplet 410, the yarns being identified as 122A, 122B and 122C; and FIGS. 5D to 5F show the respective paths of the three members of an MS triplet 420, the yarns being identified as 222A, 222B and 222C.

In a similar manner to the pairs of the embodiment shown in FIGS. 1 to 3, the members of the PS warp yarn triplets alternate between the PS layer 412 and the intermediate layer 432, and do not appear in the MS layer 422; and they alternate with each other so that each in turn interweaves alone with paper side layer weft yarns 414, to form together a single combined path in the PS layer 412, and each in turn interweaves with selected intermediate weft yarns 430. Similarly, the members of the MS warp yarn triplets 420 alternate between the MS weft yarns 424 in the MS layer 422 and the intermediate layer 432, and do not appear in the PS layer 412. As can be seen in FIGS. 5A to 5C, the three PS warp yarns 122A, 122B and 122C interweave respectively from above with intermediate weft yarns 22, 34 and 10. Similarly, as shown in FIGS. 5D to 5F, the three MS warp yarns 222A, 222B and 222C interweave respectively from below with intermediate weft yarns 10, 22 and 34. Thus, as can be seen from FIG. 4, the weft paths of the PS triplets 410 and the MS triplets 420 together provide a series of turning weft points 310, around intermediate weft yarns 10, 22 and 34, to bind the PS layer 412 and the MS layer 422 together.

Figure 6B:
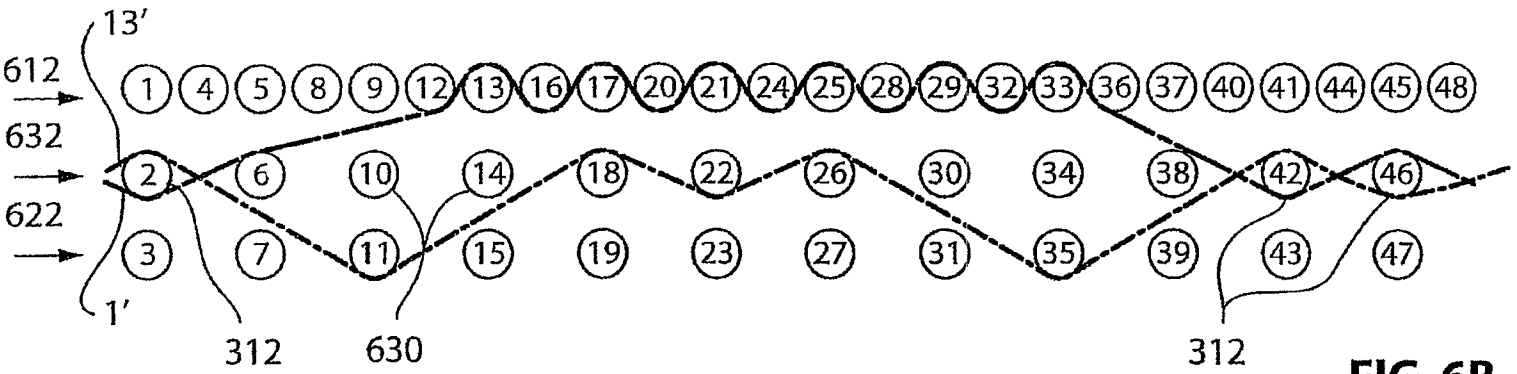
FIGS. 6B and 6C show the paths of individual warp yarns in the embodiment shown in FIG. 6A.
Figure 6C:
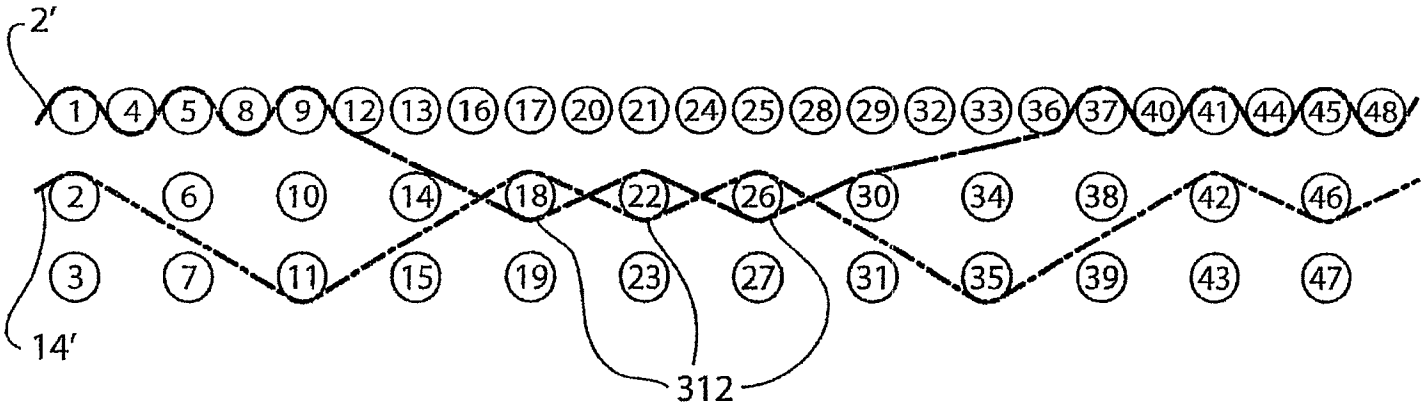

Referring now to FIGS. 6A to 6C, the features of a fabric 106 in a third embodiment of the invention are shown. FIG. 6A shows the weave pattern for the fabric 106, in which the warp yarns are shown vertically in the figure, and identified individually across the top of the figure as warp yarns 1' to 24'. The weft yarns are shown across the figure, and identified individually at the left side of the figure as weft yarns 1 to 48.

From FIGS. 6A, 6B and 6C, it can be seen that the PS warp yarns 1', 2' are woven as intrinsic warp binder yarns, and all of the MS warp yarns, e.g. warp yarns 13', 14', are woven as pairs.

Thus, each of the PS warp yarns 610 interweaves with three consecutive intermediate weft yarns 630 in the intermediate layer 632, and does not appear in the MS layer 622; and each of the MS warp yarns 620 interweaves with selected MS weft yarns 624 and with three consecutive intermediate weft yarns 630, and does not appear in the PS layer 612. Thus, for the yarn paths shown in FIG. 6B, PS warp yarn 1' and MS warp yarn 13' each interweave with intermediate weft yarns 42, 46 and 2; and in FIG. 6C, warp yarn 2' and MS warp yarn 14' each interweave with intermediate weft yarns 18, 22 and 26. This interweaving of the PS and MS warp yarns about a common turning weft point 312 serves to bind the layers of the fabric together. For each pair of MS warp yarns 620, the two members are located on opposite sides of the PS warp yarns 610 at the point at which the PS warp yarns 610 interweave with respective intermediate weft yarns, i.e. 2, 18, 22, 42, 46. The pairs of MS warp yarns 620 thus bracket the PS warp yarns 610 at the common weft turning points, preventing lateral displacement of the PS warp yarns 610 at those points. In this embodiment, the MS layer 622 is woven according to a 6 shed twill pattern, to provide MS weft floats over five warp pairs (ten warp yarns).

Figure 11:
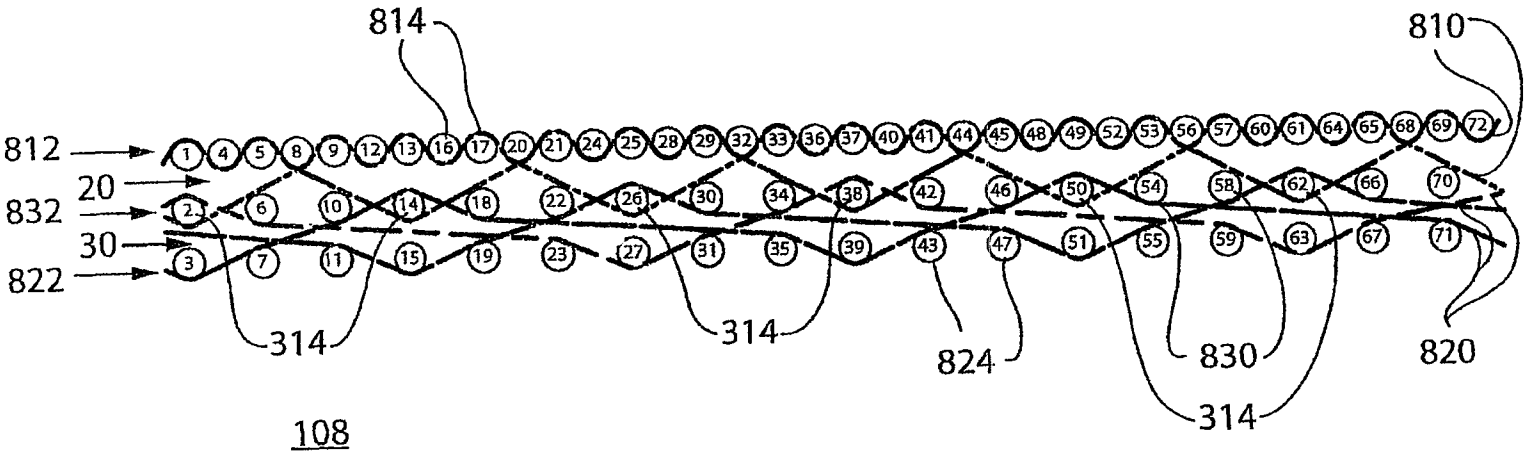
FIG. 11 shows the warp yarn paths of a fabric in a fourth embodiment of the invention, in which the upper warp yarns comprise pairs and the lower warp yarns comprise triplets.
Figure 12A:
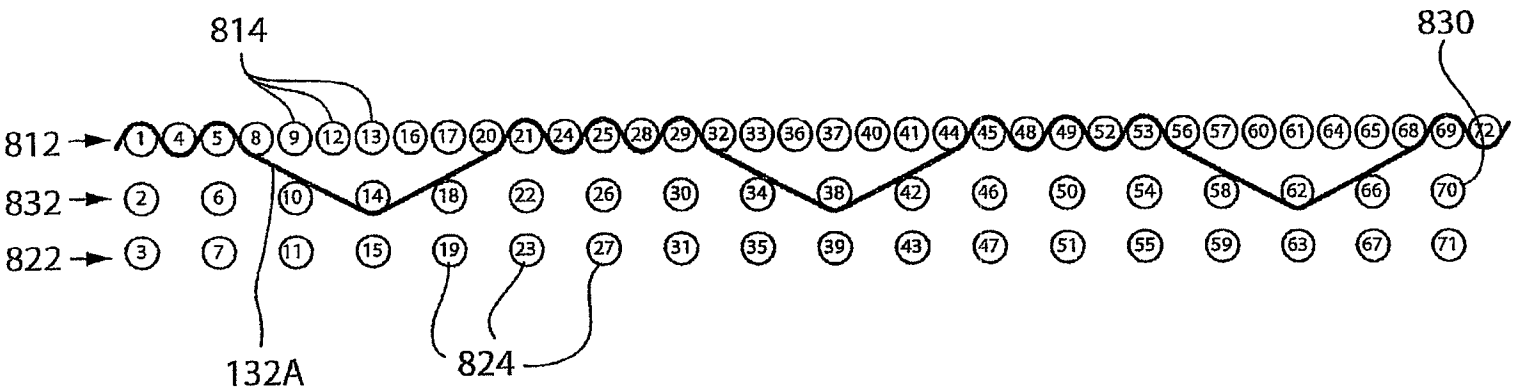
FIGS. 12A to 12E show the respective individual paths of two upper warp yarns and three lower warp yarns in the embodiment shown in FIG. 11.
Figure 12B:
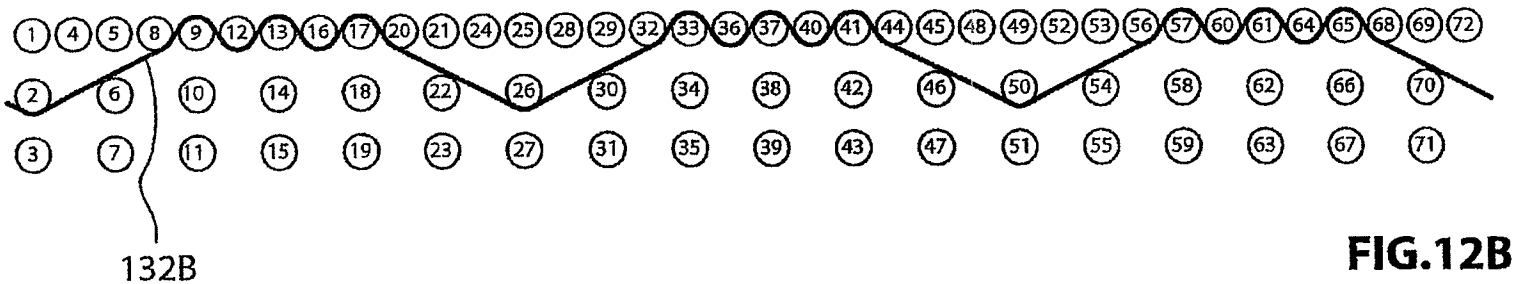
Figure 12C:
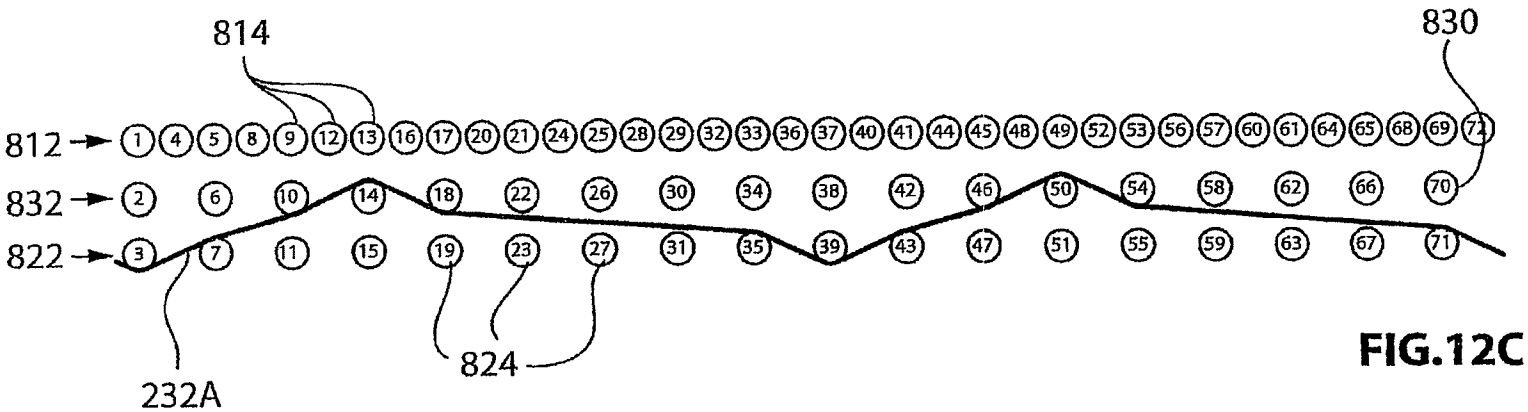
Figure 12D:
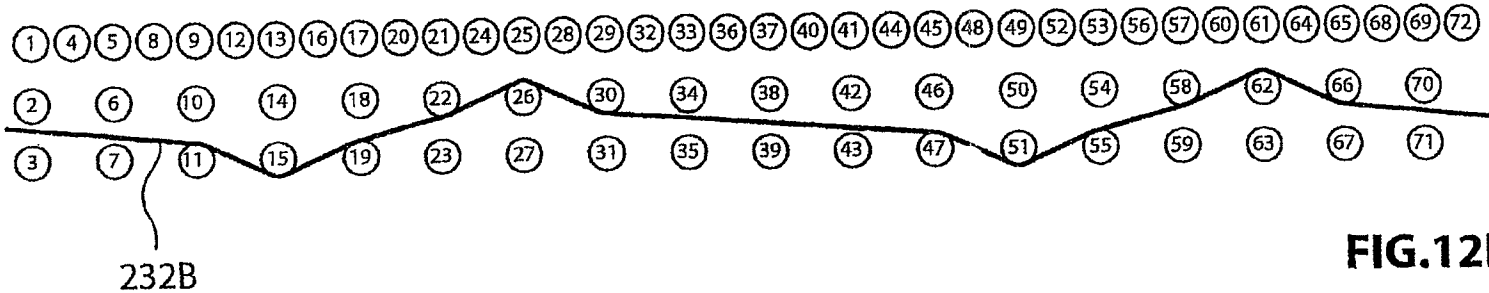
Figure 12E:
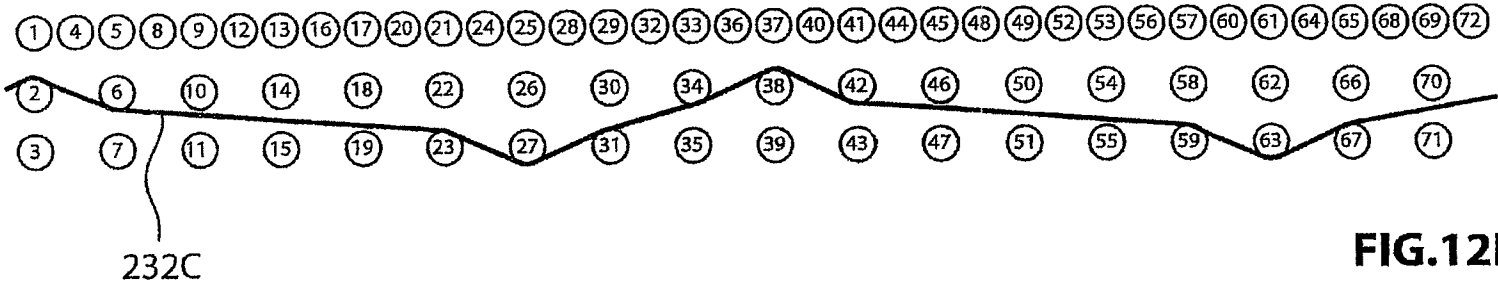

Referring to FIGS. 11, 12A to 12E, a fabric 108 of a fourth embodiment of the invention is shown, in which the PS warp yarns 810 are woven as pairs, and the MS warp yarns 820 are woven as triplets. FIGS. 12A, 12B show the paths of the two members of a pair of PS warp yarns 810, identified as warp yarns 132A and 132B; and FIGS. 12C, 12D and 12E respectively show the paths of the three members of a triplet of MS warp yarns 820, identified as 232A, 232B and 232C. Similarly to the pairs of PS warp yarns 130 shown in FIG. 1, the two members 132A, 132B of each pair together define a single combined path in the PS layer 812 of the fabric 108, alternately interweaving with the PS weft yarns 814, and exchanging positions between the PS layer 812 and the intermediate layer 832 under PS weft yarns 8, 20, 32, 44, 56 and 68. While in the intermediate layer 832, warp yarn 132A interweaves with intermediate weft yarns 14, 38 and 62; and warp yarn 132 B interweaves with intermediate weft yarns 2, 26 and 50.

Similarly to the triplets of MS warp yarns 420 shown in FIG. 4, the three members of each triplet of MS warp yarns 820 interweave with the MS weft yarns 824, and with the intermediate weft yarns 830. As can be seen from FIGS. 12C, 12D and 12E respectively, MS warp yarn 232A interweaves with intermediate weft yarns 14 and 50; MS warp yarn 232B interweaves with intermediate weft yarns 26 and 62; and MS warp yarn 232C interweaves with intermediate weft yarns 2 and 38. Thus, each of the three members of each triplet of MS warp yarns 820 interweaves from below with two intermediate weft yarns 830, concurrently with alternate members of a pair of PS warp yarns 810, to form common turning weft points 314, to bind the layers of the fabric together.

In each of FIGS. 1, 4 and 11, the two centre planes 20, 30 can readily be seen. In exemplary FIG. 1, a first centre plane 20 lies between the PS layer 100 and the intermediate layer 300, and a second centre plane 30 lies between the intermediate layer 300 and the MS layer 200. From FIG. 1, it can be seen that the internal floats of the PS warp yarns 130 between the PS layer 100 and the intermediate layer 300 will influence the drainage in the first centre plane 20; similarly the internal floats of the MS warp yarns 230 between the MS layer 200 and the intermediate layer 300 will influence the drainage in the second centre plane 30. Thus, in the fabrics of the invention, there are at least two "centre plane resistances", each of which is distinct from the other.

Figure 7:
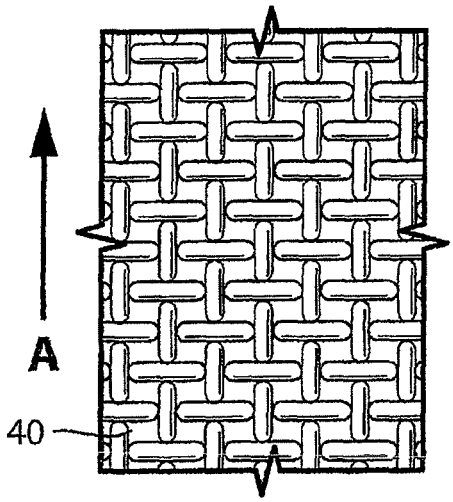
FIG. 7 shows the paper side drainage area of a fabric of the prior art.
Figure 8:
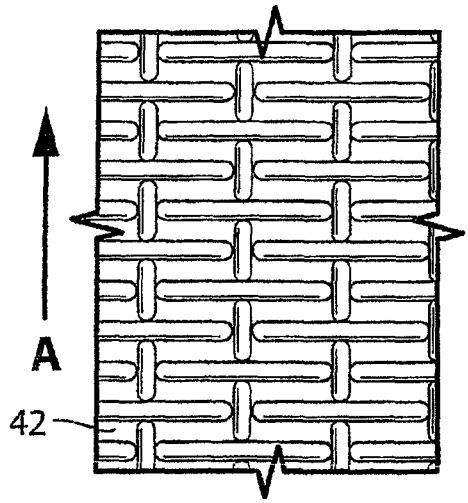
FIGS. 8 to 10 respectively show the paper side drainage areas of three fabrics of the invention.
Figure 9:
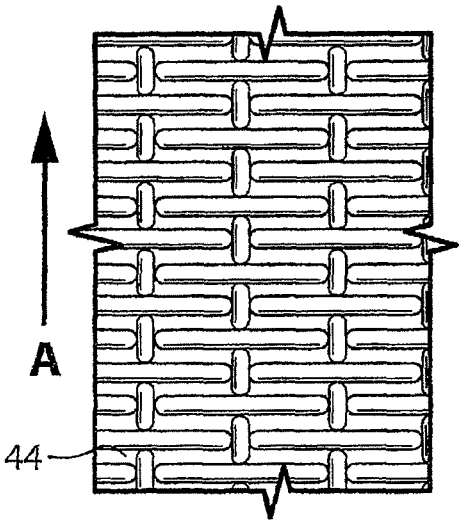
Figure 10:
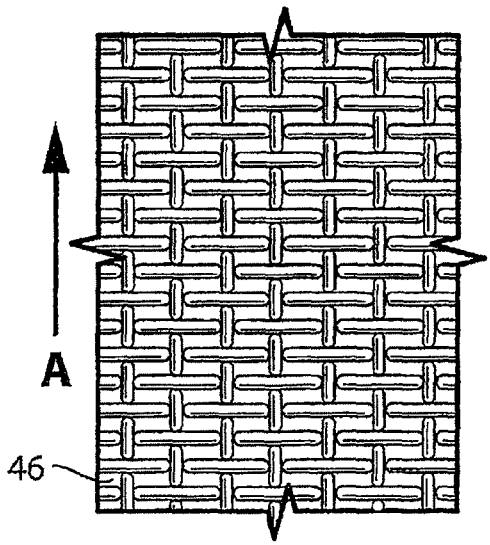

Referring now to FIGS. 7 to 10, some of the advantages of the fabrics of the invention can be seen. FIG. 7 shows the paper side drainage area of a fabric of the prior art; and in contrast, each of FIGS. 8 to 10 shows the paper side drainage area of a fabric of the invention. In each of these four figures, the arrow A indicates the machine direction of the fabric. From FIGS. 8 and 9, it can be seen that an advantageously increased drainage area can be provided, through drainage openings 42 and 44, as compared with openings 40 shown in FIG. 7, without any increase in the MD support length. From FIG. 10, it can be seen that significantly finer yarns can be used in the PS, while maintaining the increased drainage area, and additionally reducing the MD support length, while the stability of the fabric is maintained, in particular by the securing of the PS warp yarns at the common turning points with the MS warp yarns around the intermediate weft yarns, within the overall weave patterns for the fabrics of the invention, for example as described above in relation to FIG. 1.

As noted above, because the paper and machine side layer weave patterns are completely distinct from one another, the designs for each of the PS and MS layer can be selected to optimize the properties required for the specific intended end use of the fabric, including weaving the yarns of either layer as individual yarns, or grouped in various combinations of pairs or triplets.

Similarly, as the PS warp yarns and the MS warp yarns do not pass into the other layer, mutual compatibility is not required. Thus the materials for the warp yarns, and their relative dimensions, can be selected according to the intended end use of the fabric, from any of the materials known and used in the art, including monofilaments or multifilaments, and shaped with any suitable cross-sectional configuration. Further, as noted above, the intermediate weft yarns can be flocked yarns, and some of the intermediate yarns can be constructed of stainless steel.

The invention claimed is:

1. A flat woven industrial filtration fabric, having a paper side layer with a paper side surface and a machine side layer with a machine side surface, the fabric being woven according to a first repeating weave pattern and comprising:

(a) paper side layer weft yarns;

(b) machine side layer weft yarns;

(c) intermediate weft yarns located between the paper side layer and the machine side layer;

(d) first warp yarns; and (e) second warp yarns, wherein:

(i) the first warp yarns all comprise groups of at least two members and are interwoven with the paper side layer weft yarns and the intermediate weft yarns according to a second repeating weave pattern wherein the members of each group together form a single combined path on the paper side surface of the fabric;

(ii) the second warp yarns all comprise groups of at least two members and are interwoven with the machine side layer weft yarns and the intermediate weft yarns according to a third repeating weave pattern wherein the members of each group together form a single combined path on the machine side surface of the fabric; and (iii) at each location at which a first warp yarn interweaves with an intermediate weft yarn, a second warp yarn interweaves with the same intermediate weft yarn, and (iv) at each location at which a second warp yarn interweaves with an intermediate weft yarn, a first warp yarn interweaves with the same intermediate weft yarn.

2. A fabric according to claim 1, wherein all the second warp yarns comprise pairs, and for each pair the members together form a single combined path on the machine side surface of the fabric.

3. A fabric according to claim 1, wherein all the second warp yarns comprise groups of triplets, and for each group the members together form a single combined path on the machine side surface of the fabric.

4. A fabric according to claim 1, wherein all the first warp yarns comprise groups of triplets.

5. A fabric according to claim 1, wherein the second repeating weave pattern is selected from the group consisting of a plain weave and an over 2, under 1 pattern.

6. A fabric according to claim 1, wherein each of the paper side layer weft yarns has a cross-sectional area which is less than a cross-sectional area of each of the machine side layer weft yarns and the intermediate weft yarns.

7. A fabric according to claim 1, wherein at least some of the intermediate layer weft yarns have a cross-sectional area which is greater than the cross-sectional area of each of the paper side layer weft yarns and the machine side layer weft yarns.

8. A fabric according to claim 7, wherein each of the intermediate layer weft yarns has a cross-sectional area which is greater than the cross-sectional area of each of the paper side layer weft yarns and the machine side layer weft yarns, and the cross-sectional area of each of the machine side layer weft yarns is at least equal to the cross-sectional area of each of the paper side layer weft yarns.

9. A fabric according to claim 1, wherein each of the second warp yarns has a cross-sectional area which is at least equal to the cross-sectional area of each of the first warp yarns.

10. A fabric according to claim 1, wherein each of the second warp yarns interweaves with at least one machine side layer weft yarn in each repeat of the first repeating weave pattern.

11. A fabric according to claim 1, wherein each of the second warp yarns interweaves with at least one intermediate layer weft yarn in each repeat of the first repeating weave pattern.

12. A fabric according to claim 1, wherein the intermediate weft yarns are flocked yarns each comprising a longitudinal core surrounded perimetrically along its length by a plurality of protruding fibrils each having a first free end and a second end affixed to the core.

13. A fabric according to claim 1, wherein the intermediate weft yarns are constructed of different materials from the paper side layer weft yarns and the machine side layer weft yarns.

14. A fabric according to claim 13, wherein the paper side layer weft yarns are constructed of different materials from the machine side layer weft yarns.

15. A fabric according to claim 1, wherein the fabric is woven to a pattern requiring at least 12 sheds in the loom.

16. A fabric according to claim 15, wherein the fabric is woven to a pattern requiring at least 24 sheds in the loom.

17. A fabric according to claim 1, wherein the fabric has a first center plane resistance between the paper side layer weft yarns and the intermediate weft yarns, and a second center plane resistance between the intermediate weft yarns and the machine side layer weft yarns, wherein the center plane resistance is the quantity of straight through continuous drainage openings in one repeat of the weave pattern of a fabric, expressed as a percentage of the entire surface area of the repeat, and each of the first center plane resistance and the second center plane resistance is between 5% and 25%.

18. A fabric according to claim 17, wherein the first center plane resistance is substantially equal to the second center plane resistance.

19. A fabric according to claim 17, wherein the first center plane resistance is different from the second center plane resistance.

20. A fabric according to claim 19, wherein the first center plane resistance is greater than the second center plane resistance.

21. A fabric according to claim 1, comprising a papermaker's fabric.

22. A fabric according to claim 21, comprising a forming fabric.

23. A fabric according to claim 21, comprising a press fabric.

* * * * *